US011253041B2

(12) United States Patent
Fragner

(10) Patent No.: US 11,253,041 B2
(45) Date of Patent: Feb. 22, 2022

(54) HAIR BRUSH WITH INTEGRAL HAIR FASTENER APPLICATOR

(71) Applicant: Paul Fragner, Armonk, NY (US)

(72) Inventor: Paul Fragner, Armonk, NY (US)

( * ) Notice: Subject to any disclaimer, the term of this patent is extended or adjusted under 35 U.S.C. 154(b) by 846 days.

(21) Appl. No.: 15/815,030

(22) Filed: Nov. 16, 2017

(65) Prior Publication Data

US 2018/0132590 A1 May 17, 2018

Related U.S. Application Data

(60) Provisional application No. 62/423,500, filed on Nov. 17, 2016.

(51) Int. Cl.

| | |
|---|---|
| ***A45D 24/10*** | (2006.01) |
| ***A45D 8/34*** | (2006.01) |
| ***A46B 15/00*** | (2006.01) |
| ***A45D 8/36*** | (2006.01) |
| ***A46B 9/02*** | (2006.01) |
| ***A45D 24/00*** | (2006.01) |

(52) U.S. Cl.

CPC ..... *A45D 24/10* (2013.01); *A45D 8/34* (2013.01); *A45D 8/36* (2013.01); *A46B 9/023* (2013.01); *A46B 15/0055* (2013.01); *A45D 2024/002* (2013.01); *A46B 2200/104* (2013.01); *A46B 2200/40* (2013.01)

(58) Field of Classification Search

CPC ..... A45D 2002/007; A45D 2002/008; A45D 2/04; A45D 2/12; A45D 24/007; A45D 24/04; A45D 24/10; A45D 8/34; A45D 8/24; A45D 8/36; A46B 15/0061; A46B 15/0055; A46B 2200/00; A46B 2200/104; A46B 2200/40; A46B 9/023; Y10T 24/314; Y10T 24/1408; B25B 7/00; B25B 7/12; B25B 7/22; B25B 27/205; B25B 25/005; B65B 13/02; B65B 13/025; B65B 13/285; B65H 51/02; B65H 51/14; A41G 5/0086

USPC .... 132/212, 219, 107, 200, 120, 119.1, 127, 132/144, 275, 147, 148, 234, 321, 242, 132/262, 245, 246, 247, 248, 251; 15/105; 74/489; 81/9.3; 173/170; 294/99.2, 103.1; 100/29–34; 289/17

See application file for complete search history.

(56) References Cited

U.S. PATENT DOCUMENTS 1,047,868 A 12/1912 Williams
2,147,978 A * 2/1939 Kantor ..... A45D 6/045 132/264

(Continued)

FOREIGN PATENT DOCUMENTS

DE 102015106562 A1 * 6/2016 ..... B25B 7/16

*Primary Examiner* — Tatiana L Nobrega
*Assistant Examiner* — Sarah Woodhouse
(74) *Attorney, Agent, or Firm* — Leason Ellis LLP

(57) ABSTRACT

A hair brush configured to apply a hair fastener to a bundle of hair includes a housing having a handle portion and a brush portion. The hair brush also has an actuator that is coupled to the housing and a hair fastener applicator mechanism that is coupled to the housing and to the actuator such that operation of the actuator causes the hair fastener applicator mechanism to move between an open position in which the hair fastener is held in an elongated state that can receive the bundle of hair and a closed position in which the hair fastener is wrapped and secured around the bundle of hair.

14 Claims, 21 Drawing Sheets

(56) References Cited

U.S. PATENT DOCUMENTS

| | | | | | |
|---|---|---|---|---|---|
| 3,751,769 | A * | 8/1973 | Reiner | A45D 8/34 | 24/300 |
| 3,974,841 | A | 8/1976 | Weisman | | |
| 4,574,416 | A | 3/1986 | Stewart et al. | | |
| 5,273,058 | A * | 12/1993 | Edwards | A45D 2/00 | 132/119 |
| 5,488,963 | A * | 2/1996 | Fishman | A45D 2/00 | 132/212 |
| 5,535,765 | A * | 7/1996 | Takashima | A45D 8/34 | 132/273 |
| 6,280,281 | B1 | 8/2001 | Unalp | | |
| 6,314,966 | B1 * | 11/2001 | Yokokawa | A45D 6/04 | 132/148 |
| 8,887,738 | B2 | 11/2014 | Ward | | |
| 2010/0050352 | A1 * | 3/2010 | Deris | A45D 29/20 | 15/105 |

* cited by examiner

HAIR BRUSH WITH INTEGRAL HAIR FASTENER APPLICATOR

CROSS-REFERENCE TO RELATED APPLICATION

The present application claims priority to U.S. patent application Ser. No. 62/423,500, filed Nov. 17, 2016, which is hereby incorporated by reference in its entirety.

TECHNICAL FIELD

The present application relates generally to the field of hair styling. More specifically, the present application relates to an apparatus for applying a hair fastener to a user's hair.

BACKGROUND

Hair fasteners are routinely used to group together portions of a person's hair. These hair fasteners can be used for styling purposes, such as, for gathering loose ends of a portion of hair into a "ponytail" hairstyle. Additionally, hair fasteners can be used for more practical reasons, such as to prevent hair from shifting into the face of the user, or to prevent hair from moving while a user is performing certain physical tasks (e.g., exercising, sports).

There are several different types of hair fasteners including various hair clips. A standard hair fastener, particularly for those with medium to long length hair is a hair tie. Hair ties are typically circular elastic bands that are designed to gather and hold at least a portion of the loose ends of a person's hair.

Despite having various options for hair fastening, fastening and/or styling one's hair is still a cumbersome and time-consuming process for many people, as it generally requires the use of both hands and the portion of hair to be fastened must be gathered together first before applying the fastener. Additionally, the process of fastening one's own hair can be difficult, as the person may miss certain strands of hair or not fasten the hair fastener tightly enough, which can result in a sloppy appearance and/or hair escaping the fastener.

Accordingly, there is a need for improvement in the art for fastening hair that increases the efficiency and the effectiveness of fastening one's hair.

SUMMARY

In accordance with one embodiment, a hair brush configured to apply a hair fastener to a bundle of hair is provided. The hair brush not only acts as a traditional hair brush in that it includes bristles used to brush the hair but also is configured to apply the hair fastener to the bundle by the user manipulating an actuator. The hair brush includes a housing having a handle portion and a brush portion. The hair brush also has an actuator that is coupled to the housing and a hair fastener applicator mechanism that is coupled to the housing and to the actuator such that operation of the actuator causes the hair fastener applicator mechanism to move between an open position in which the hair fastener is held in an elongated state that can receive the bundle of hair and a closed position in which the hair fastener is wrapped and secured around the bundle of hair. The actuator can be in the form of a trigger that can be depressed by the user along the handle portion of the brush. In one exemplary embodiment, the hair fastener is an elastic member that has a ball formed at a first end and a loop formed at an opposite end.

In another embodiment, a method of applying a hair fastener to a bundle of hair comprises the steps of: (a) securing the hair fastener to a hair fastener applicator mechanism that is formed at a distal end of a hair brush such that opposing first and second ends of the hair fastener are retained with an intermediate portion of the hair fastener extending across an arcuate shaped cutout formed at the distal end of the hair brush; (b) directing the bundle of hair into the arcuate shaped cutout resulting in deflection of the intermediate portion; (c) actuating the hair fastener applicator mechanism to cause the first and second ends of the hair fastener to be driven toward one another and then finally the first and second ends of the hair fastener are coupled to one another to form a continuous hair fastener secured about the bundle of hair; and (d) releasing the hair fastener applicator mechanism to cause the continuous hair fastener to be ejected therefrom.

DETAILED DESCRIPTION OF CERTAIN EMBODIMENTS OF THE DISCLOSURE

By way of overview and introduction, various apparatuses and methods are described herein for providing and using a hair brush with an integral hair fastener applicator. It can be appreciated that despite the technological advances in hair styling, the activity of fastening and styling portions of someone's hair, particularly one's own hair, can be time-consuming, awkward, and cumbersome.

In an effort to make hair styling and fastening an efficient process, the apparatuses and methods described herein enable a person to quickly style and fasten at least a portion of their hair using a hair brush having an integral hair fastener applicator. However, instead of styling one's hair in a conventional way (e.g., combing or brushing the hair, and then applying one more hair fasteners to the hair), a person can use a hair brush having an integral hair fastener applicator. The hairbrush with the integral hair fastener application allows a user to seamlessly style and fasten his or her hair using a single device, such that at least a portion of the user's hair can be fastened after brushing without having to put down the hairbrush and manually apply the hair fastener (e.g., hair tie).

More specifically, in accordance with at least one embodiment of the present application, a person can use the hairbrush with the integral hair fastener applicator to both gather a portion of his or her hair and fasten that portion of his or her hair. In one or more embodiments, the fastening of the portion of the hair with the fastener applicator can be automated with the apparatus of the present application.

The following detailed description is directed to apparatuses and methods for providing and using a hair brush with an integral hair fastener applicator. The referenced apparatuses and methods are now described more fully with reference to the accompanying drawings, in which one or more illustrated embodiments and/or arrangements of the apparatuses and methods are shown. The apparatuses and methods are not limited in any way to the illustrated embodiments and/or arrangements as the illustrated embodiments and/or arrangements described below are merely exemplary of the apparatuses and methods, which can be embodied in various forms, as appreciated by one skilled in the art. Therefore, it is to be understood that any structural and functional details disclosed herein are not to be interpreted as limiting the apparatuses and methods, but rather, are provided as a representative embodiment and/or arrangement for teaching one skilled in the art one or more ways to implement the apparatuses and methods.

Figure 1:
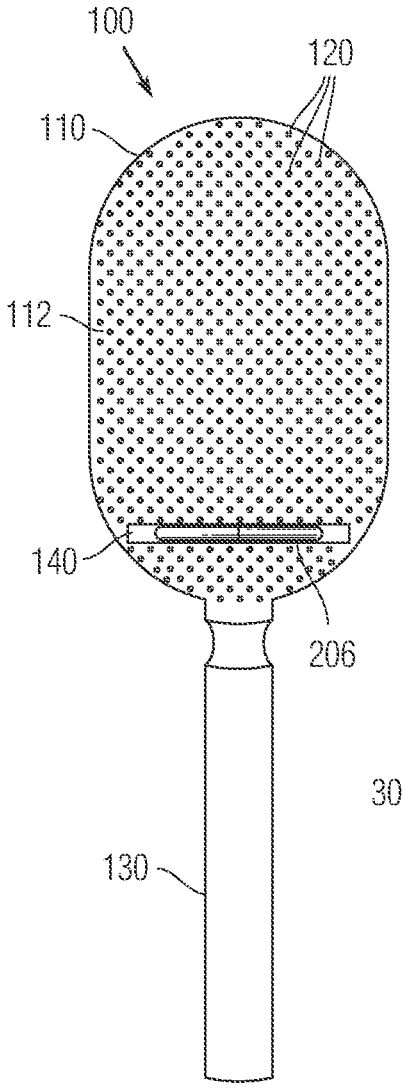
FIG. 1 is a top plan view of a hair brush with an integral hair fastener applicator in accordance with one or more embodiments.
Figure 2:
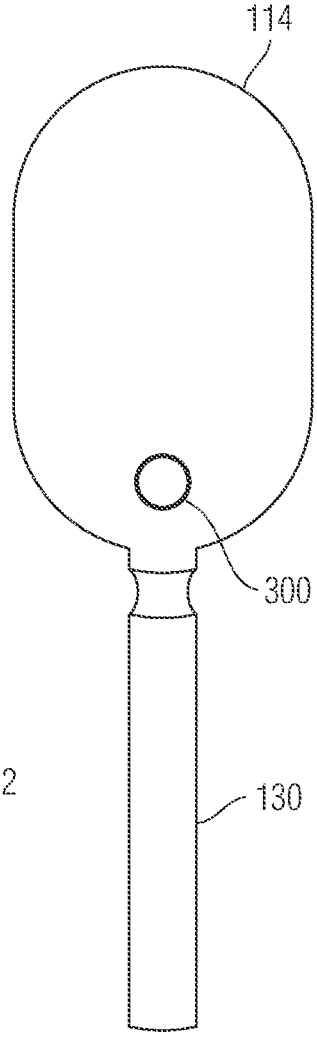
FIG. 2 is a bottom plan view of the hair brush of FIG. 1.
Figure 4D:
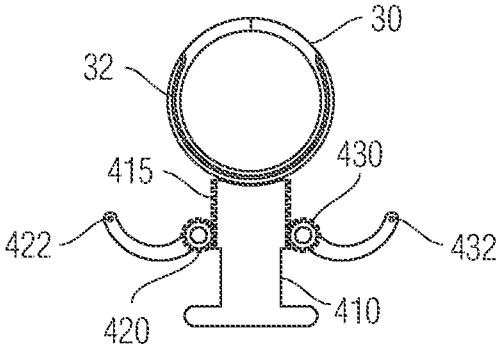
FIG. 4D is a top plan view of the hair brush with an integral hair fastener applicator in accordance with one or more embodiments showing the applicator in a fourth position.

FIGS. 1 and 2 show a front side and back side, respectively, of a hair brush 100 according to an exemplary embodiment. The hair brush 100 includes an integral hair fastener applicator mechanism ("applicator mechanism"). Referring to FIGS. 1 and 2, the hair brush 100 comprises a head 110 having a front portion 112 and a back portion 114. As shown in FIG. 1, the front portion 112 comprises a plurality of bristles 120 configured to brush a person's hair. The bristles 120 can vary in length and stiffness depending on the type of hair of the user. In one or more embodiments, the bristles 120 have a consistent length and stiffness for the entire hair brush. In at least one embodiment, the bristles 120 can vary in length and/or stiffness. Bristles 120 are formed of any number of different materials, including but not limited to different synthetic materials. The hair brush 100 further includes a handle 130 configured to allow the user to hold and manipulate the hair brush 100.

With continued reference to FIGS. 1 and 2, in one or more implementations, the hair brush 100 can include an opening or slot 140 positioned on the front portion 112 of the head 110, wherein the opening 140 is in communication with the applicator mechanism. As shown in FIG. 1, the opening 140 can be located at a bottom part of the front portion 140 proximate to the handle 130. However, it should be understood that in other implementations, the opening 140 can be located at other locations within the front portion 112. In one or more embodiments, no hair bristles 120 are located at the location of the opening 140. The opening 140 is configured to allow passage of one or more hair fasteners 200 (e.g., hair ties) for applying to a person's hair. As such, the size and shape of the opening 140 is such that it can accommodate at least one hair fastener 200.

In one or more embodiments, and as discussed in the embodiments below, the one or more hair fasteners 200 are hair ties. The hair fastener 200 is generally made of stretchable and/or elastic material configured to securely fasten a portion of a user's hair. The stretchable and/or elastic hair fastener 200 is substantially circular in shape and thus defines an opening therebetween for accommodating the portion of hair to be fastened. In accordance with certain embodiments, the hair fastener 200 can comprise two free ends that are releasably connected to form a substantially circular hair fastener (can be thought of as having a split ring construction).

The two free ends can comprise one of a variety of closure mechanisms including but not limited to snap fit fasteners (male and female mating parts), hook and loop fasteners, and magnets, etc. The elements at the two free ends that define the closure mechanism thus permits the free ends of the hair fastener 200 to be connected to form a continuous structure formed of elastic material. One or more of the free ends can thus be manipulated to bring the ends together in a manner that results in closure of the hair fastener 200.

Figure 3A:
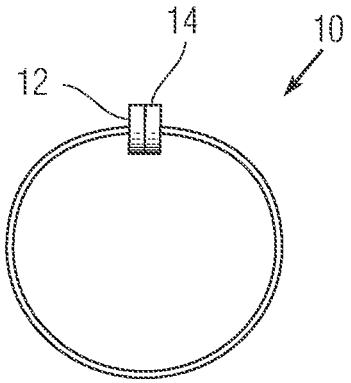
FIG. 3A is front view of a hair fastener (tie) of a first embodiment.

FIG. 3A shows a fastener 10 that has two free ends that are configured to open and mate with one another to form a continuous structure. The ends of the fastener 10 include hook and loop material 12, 14 that permit attachment of the two ends.

Figure 3B:
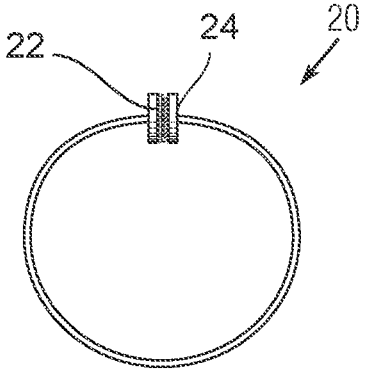
FIG. 3B is front view of a hair fastener (tie) of a second embodiment.

FIG. 3B shows a fastener 20 that has two free ends that are configured to open and mate with one another to form a continuous structure. The two ends include two magnets 22, 24 for attaching the two ends.

Figure 3C:
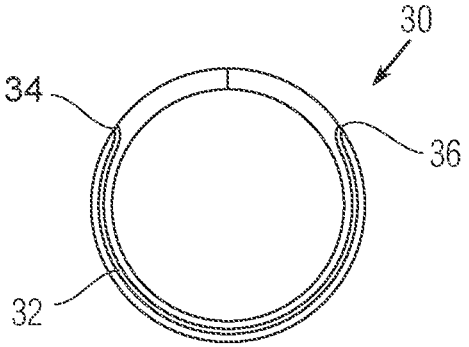
FIG. 3C is front view of a hair fastener (tie) of a third embodiment.

FIG. 3C shows a fastener 30 that has two free ends that are configured to open and mate with one another to form a continuous structure. The fastener 30 includes a groove 32 formed along an exterior surface thereof. The groove 32 has a two free ends 34, 36.

Figure 3D:
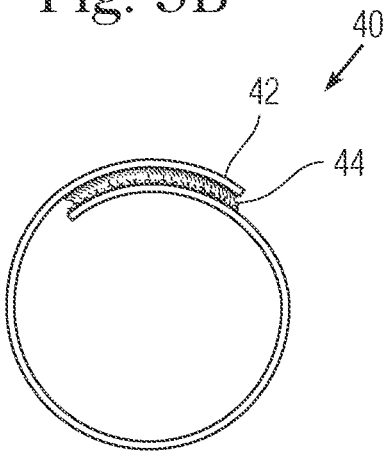
FIG. 3D is front view of a hair fastener (tie) of a fourth embodiment.

FIG. 3D shows a fastener 40 that has two free ends that are configured to open and mate with one another to form a continuous structure. The ends of the fastener 40 include hook and loop material 42, 44 that permit attachment of the two ends.

Figure 3E:
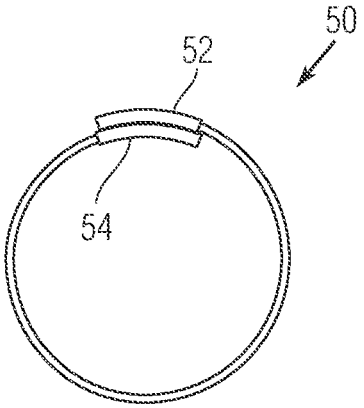
FIG. 3E is front view of a hair fastener (tie) of a fifth embodiment.

FIG. 3E shows a fastener 50 that has two free ends that are configured to open and mate with one another to form a continuous structure. The two ends include two magnets 52, 54 for attaching the two ends.

Figure 3F:
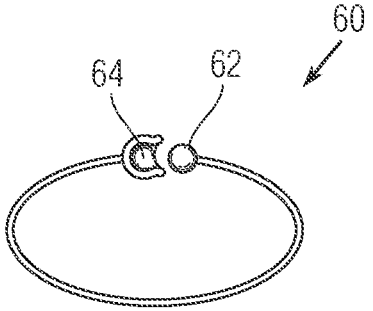
FIG. 3F is front view of a hair fastener (tie) of a sixth embodiment.

In one embodiment, FIG. 3F shows a fastener 60 with a male/female arrangement in which one end includes the male part 62 that is a ball and the female part 64 is a socket. In another embodiment, the ball and socket are formed of magnetic material so as to further encourage these two free ends of the fastener toward one another and into mating contact.

In at least one embodiment, the hair fastener 200 can comprise no free ends and is substantially circular and continuous in nature.

Referring again to FIG. 2, the hair brush 100 can further include an actuator 300. The actuator 300 is in communication with the applicator mechanism and is configured to cause the applicator mechanism to apply the fastener to the desired portion of hair. In one or more embodiments, as exemplified in FIG. 2, the actuator 300 is located on the back portion 114 of the hair brush 100. More specifically, as shown in FIG. 2, the actuator 300 can be located at a bottom part of the back portion 114. In one or more implementations, the location of the actuator 300 on the back portion 114 corresponds or closely corresponds to the location of the opening 140 on the front portion 112. It should be understood, however, that in certain embodiments the actuator 300 can be located at various portions on the hair brush 100 regardless of the location of the opening 140. In one or more embodiments, the location of the actuator 300 is such that a user can use one hand to both activate the actuator 300 and hold the hair brush 100 by the handle 130. In one or more implementations, the actuator 300 is a button. In other implementations, the actuator can be a switch or slider or other type of actuator that allows a user to turn the actuator on and off.

In at least one embodiment the applicator mechanism is a multi-phase application and generally, the applicator mechanism has three phases. The first phase is one in which the applicator mechanism advances the hair fastener 200 out of the opening 140 towards a portion of hair. In certain embodiments of the first phase, the hair fastener 200 is advanced out of the opening 140 to a height that is above the tips of the bristles 120. In at least one embodiment, the hair fastener 200 is advanced out of the opening 140 using a spring mechanism. In other words, a biasing force is applied to a carrier that supports the hair fastener 200 to cause advancement of the carrier and hair fastener 200. The biasing force releases energy when the actuator is moved to one state (e.g., the on state as by unlatching the actuator).

The second phase is one in which the hair fastener 200 assumes a position in which the bundle of hair can be inserted therein. More specifically, once the hair fastener 200 advances beyond the bristles 120, it is in position for being applied to a bundle of hair. As described herein, the hair fastener in this position is in a state in which the free ends of the hair fastener 200 are separated from one another, thereby creating a gap (space) between the free ends, with the gap being sized to receive the bundle of hair.

In one embodiment, the second phase is one in which the state of the hair fastener 200 is altered and more particularly, the hair fastener can move from either a closed position to an open position or alternatively, can move from an open position to a closed position.

In one embodiment, the carrier that supports and holds the fastener is in a closed position in its natural rest state and therefore, the two free ends of the hair fastener are joined. For example, the carrier can be formed of a memory material, such as nitinol or the like, that in the rest state causes the hair fastener to be in the closed position. For example, the carrier can have a fixed part (fixed arm or finger) and a flexible part that moves relative to the fixed part between open and closed positions. In the rest position of the carrier, the flexible finger is in the closed position and abuts the fixed part, resulting in the two free ends of the hair fastener being joined.

After the hair fastener advances beyond the bristles 120, the user can alter the state of the fastener by manipulating the actuator. For example, operation of the actuator can cause the flexible finger to be driven apart from the fixed part. Since one free end of the hair fastener is coupled to the flexible finger, this free end of the fastener is driven away from the other free end, thereby opening the hair fastener to allow insertion of the bundle of hair between the two free ends of the hair fastener.

The hair fastener remains open since the user maintains a force against the actuator. Since the carrier wants to return to the rest position when no force is applied, once the hair bundle is received within the two spaced free ends of the hair fastener, the user can simply remove the force being applied to the actuator and this causes the flexible finger to move back toward the fixed part, thereby causing the free ends of the hair fastener to be drawn back together and into a mating relationship.

The carrier can be configured such that once the free ends of the hair fastener are rejoined to capture the hair bundle, the connected hair fastener can be easily ejected from the carrier. For example, when the brush is moved in a direction away from the head of the user, a holding force of the carrier can be overcome and this results in the hair fastener being ejected and free of the carrier. Since the hair fastener is effectively anchored to the head, movement of the brush in a direction away from the head can cause holding features of the carrier to disengage from the free ends of the hair fastener, thereby allowing separation between the hair fastener and the brush.

In this embodiment, the applicator mechanism thus pries open the hair fastener 200 such that the opening of the hair fastener 200 becomes larger in order to accommodate the desired portion of hair to be fastened.

In at least one alternative embodiment, the hair fastener 200 is already pried open and is in an open state. The third phase in this embodiment is one in which the applicator mechanism releases the hair fastener and closes the hair fastener around the desired portion of hair such that the portion of hair is securely fastened.

More specifically, in this embodiment, the actuator is manipulated to cause the open free ends of the hair fastener to be driven toward one another and into a locked position. For example, in an embodiment in which there is a fixed finger holding one free end of the hair fastener and a flexible finger that holds the other free end of the hair fastener. Manipulation of the actuator (applicator mechanism) causes the flexible finger to be driven toward the fixed finger, thereby causing the two free ends of the hair fastener to be driven toward and into contact with one another, thereby connecting the two free ends about a captured bundle of hair.

It will be understood that any number of different mechanisms can be used to translate the movement of the actuator into movement of the carrier and the free ends of the hair fastener. Thus, any number of mechanical linkages can be used to cause this movement. For example, a gear assembly can be used to cause the motion of the flexible finger. The actuator can, for example, be disposed along the rear face of the handle and can be driven in a direction toward the bristles 120 to cause the carrier and the held hair fastener to move from the interior of the brush through the opening 140 to the location above the bristles. Further manipulation of the actuator, such as by rotating or pivoting the actuator can cause the desired movement within the carrier and thus causes the desired movement in the hair fastener.

Other types of mechanical linkages that can be used include a rack and pinion type arrangement in which liner movement of the actuator (e.g., linear movement of the rack) to push the carrier and hair fastener out of the brush body to a location above the bristles. As the actuator moves in a linear direction, it also imparts a pivoting action in one or more parts of the carrier which causes pivoting of the flexible finger carrying one end of the hair fastener. For example, liner movement of the rack in a first direction causes pivoting of the pinion in a first direction and conversely, movement of the rack in a second direction causes pivoting of the pinion in the opposite second direction. This pivoting allows the opening and closing of the elastic hair fastener 200.

FIGS. 4A-4D show a hair fastener applicator mechanism 400 in accordance with one embodiment. It will be appreciated that the mechanism 400 is intended to be used with the brush 100 of FIGS. 1 and 2. The mechanism 400 is thus intended to be contained within a hollow interior compartment in the brush head 110 and is positioned such that it communicates with the opening 140 and it will be appreciated that a portion of the mechanism 400 serves as the actuator 300 (button). The mechanism 400 includes a shaft (rode) 410 with a free end 412 being in the form of a button or the like. The shaft 410 includes teeth 415 formed along opposing side edges thereof and thus, the shaft 410 functions as a rack.

In one embodiment, the mechanism 400 is configured to receive and hold the hair fastener itself, while in another embodiment, the mechanism 400 has a carrier that holds and retains the hair fastener in place. For ease of illustration, FIGS. 4A-D illustrate the hair fastener 30, that includes groove 32, supported by the mechanism; however, it will be understood that the groove 32 can be formed in a carrier (split ring construction) that is configured to receive and hold the hair fastener 200. In addition, the carrier (and/or the hair fastener) can be constructed such it is biased so that in a normal rest position, the carrier (and/or hair fastener) is in a closed position with the two free ends being closed and in an abutting relationship.

The mechanism 400 also includes a first claw member and a second claw member that are pivotally attached to the housing of the brush 100. The first claw member includes a first gear 420 and an elongated first claw 421 that has a distal end that includes a pin 422. The second claw member includes a second gear 430 and an elongated second claw 431 that has a distal end that includes a pin 432. Rotation of the respective gear causes rotation (pivoting) of the respective claw. The first gear 420 has teeth that mesh with teeth 415 of the rack along one side edge and the second gear 420 has teeth that mesh with teeth 415 of the rack along the other side edge. The pins 422, 432 are configured to be received within and travel along the groove 32. The reception of the pins 422, 432 into the groove 32 couples the hair fastener/carrier to the claws 421, 431.

Figure 4A:
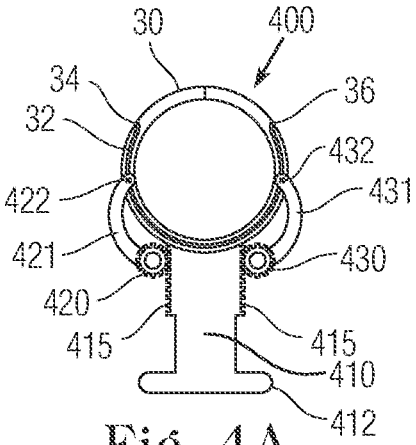
FIG. 4A is a top plan view of a hair brush with an integral hair fastener applicator in accordance with one or more embodiments showing the applicator in a first position.
Figure 4B:
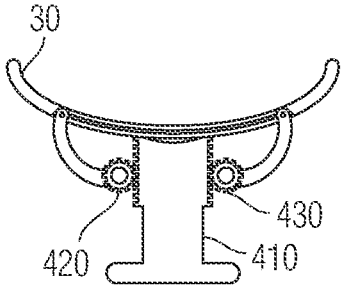
FIG. 4B is a top plan view of the hair brush with an integral hair fastener applicator in accordance with one or more embodiments showing the applicator in a second position.
Figure 4C:
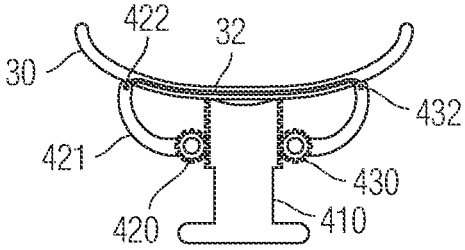
FIG. 4C is a top plan view of the hair brush with an integral hair fastener applicator in accordance with one or more embodiments showing the applicator in a third position.

FIGS. 4A-4*d* show the successive movements of the mechanism 400 as the button 412 and shaft 410 are pressed inward into the brush housing. The linear movement causes the fixed gears 420, 430 to engage the moving shaft 410/rack teeth 415 and more specifically, as the rack (shaft 410) moves in a linear manner in a first direction, the first gear 420 moves in a counterclockwise direction and the second gear 430 moves in a clockwise position. As shown in FIG. 4A, the pins 422, 432 are initially captured in the groove 32. As shown in FIG. 4B, as the rack continues to move in the first direction, the rotation of the first and second gears 420, 430 cause the claws 421, 431 to pivot in an outward manner. As the claws 421, 431 pivot the pins 422, 432 move along the groove 32 toward the respective open ends 34, 36 thereof. This action, as shown in FIG. 4B, results in the opening of the hair fastener 30 (or carrier supporting the fastener 30) as shown in FIGS. 4B and 4C. FIG. 4C shows the pins 422, 432 at the open ends 34, 36 of the groove 32. Continued movement in the first direction causes the pins 422, 432 to travel out of the open ends 34, 36, thereby disengaging the opening claws 421, 431. Since the fastener and/or carrier is biased such that at rest it assumes the closed position, once the claws 421, 431 disengage from the hair fastener/carrier, it will be biased back to the closed position shown in FIG. 4D.

It will be appreciated that the bundle of hair is inserted between the free ends of the fastener when they are in the open position, such as in FIGS. 4B and 4C.

It will also be appreciated that movement of the mechanism (shaft 410) in the first direction results in the hair fastener (or carrier) being moved into a position in which it is elevated relative to the bristles 120.

Also, the mechanism 400 can be biased (spring biased) such that once the user presses the button 412 to its innermost position, a spring biases the mechanism back to its rest position once the user removes the force being applied to the button 412. In addition, the claws can be spring biased such that once they disengage from the fastener/carrier, the claws return back to the position shown in FIG. 4A.

Figure 5:
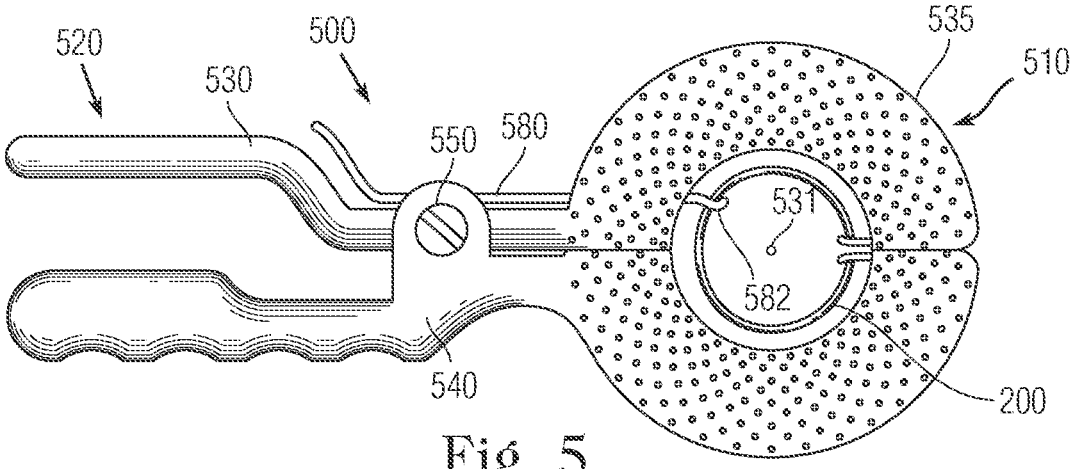
FIG. 5 is a top plan view of a hair brush with an integral hair fastener applicator in accordance with one or more embodiments showing the applicator in a first position.
Figure 6:
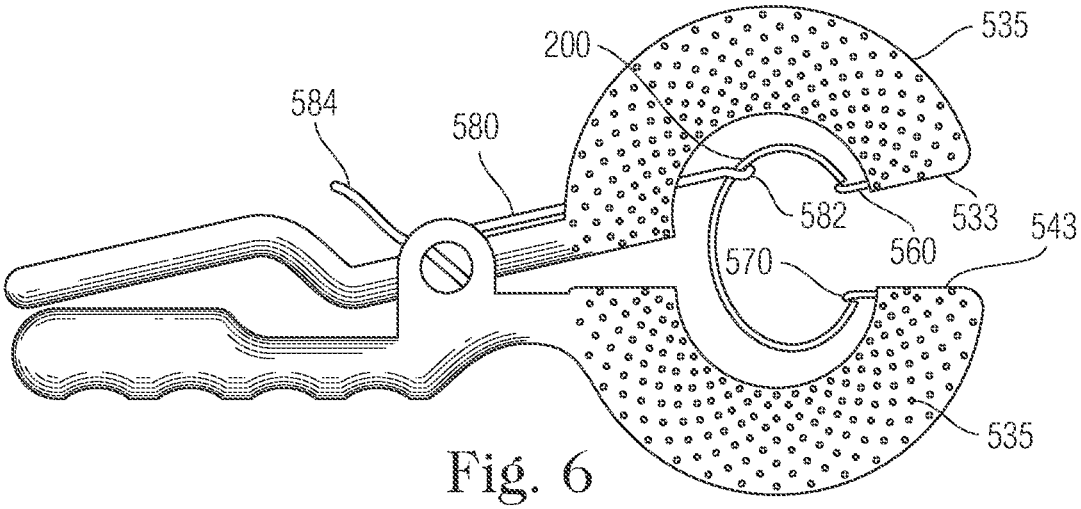
FIG. 6 is a top plan view of the hair brush with an integral hair fastener applicator in accordance with one or more embodiments showing the applicator in a second position.
Figure 7:
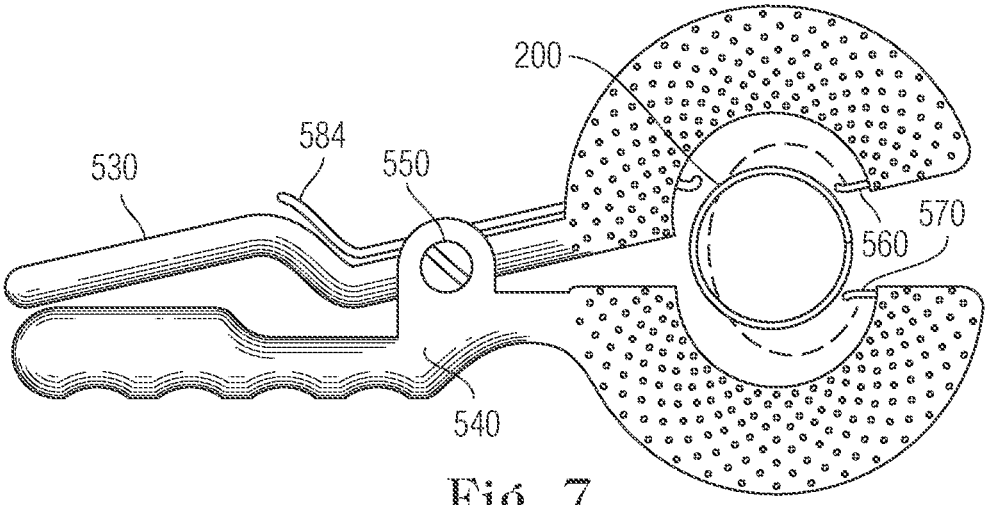
FIG. 7 is a top plan view of the hair brush with an integral hair fastener applicator in accordance with one or more embodiments showing the applicator in a third position.

FIGS. 5-7 show a hair brush 500 in accordance with one embodiment. The hair brush 500 includes a brush portion 510 and a handle portion 520. The hair brush 500 is of the type that includes a first part 530 that extends from the brush portion 510 to the handle portion 520 and a second part 540 that extends from the brush portion 510 to the handle portion 520. As shown, each of the first and second parts 530, 540 defines generally one half of the handle portion 520 and one half of the brush portion 510. The first and second parts 530, 540 are pivotally attached to one another at a pivot 550, thereby allowing the two parts 530, 540 to open and close relative to one another.

The brush portion of the first part 530 generally has a semi-circular shape and the brush portion of the second part 540 generally has a semi-circular shape, with the two brush portions facing one another so to form a generally circular shaped opening 531 therebetween when the first and second parts 530, 540 are in the closed positions. As shown, the two brush portions include bristles 535.

One or more of the handle portions of the first and second parts 530, 540 can be ergonomically formed to have a grip portion.

Proximate to a free end 533 of the brush portion of the first part 530 is a first retainer element 560 and similarly, proximate to a free end 543 of the brush portion of the second part 540 is a second retainer element 570. The first and second retainer elements 560, 570 can be any number of elements that are configured to releasably hold the free ends of the hair fastener 200. For example, the first and second retainer elements 560, 570 can be hook structures (e.g., J-hooks) that are configured to receive and hold the free end of the hair fastener 200. The hook structures 560, 570 are oriented so as to position the hair fastener 200 within the circular shaped opening 531. The hair fastener 200 is thus maintained in a split-ring form and extends circumferentially within the circular shaped opening 531.

The brush 500 also includes an ejector 580. The ejector 580 has a first end that includes a retaining member 582, such as a hook, that can releasably grasp and hold the hair fastener 200 at an intermediate location between the free ends thereof. The second end of the ejector 580 is a lever 584 or the like that is accessible to the user for manipulation. To eject the hair fastener 200 once it is disposed about the bundle of hair and is in a closed form, the ejector 580 is actuated (e.g., as by moving the lever 584) to cause disengagement of the hair fastener 200 from the first and second retainer elements 560, 570 as by pulling the hair fastener is a direction away from the first and second retainer elements 560, 570 thereby causing disengagement of the hair fastener 200 therefrom. The ejector 580 is configured such that the intermediate portion of the hair fastener 200 is disengaged therefrom to thereby allow the hair fastener 200, which is attached about the bundle of hair, to be free of attachment to the hair brush 500. The brush 500 can then be removed from the head/hair area of the person.

As shown in FIG. 5, the brush 500 is in a closed position with the two ends of the hair fastener 200 in an attached state. In FIG. 6, the user has opened the brush portions using the handle portions to cause free ends 533, 543 to move apart from one another, thereby creating a gap therebetween. This gap is of a size to allow the bundle of hair to pass therethrough into opening 131. Since the free ends of the hair fastener 200 are secured to the free ends 533, 543, they also separate from one another to allow passage of the hair. Once the hair bundle is received within the hair fastener 200, handle portions are closed so that it assumes the position in FIG. 5. In order to disengage the hair fastener 200 from the brush 500, the lever 584 is manipulated to pull the hair fastener 200 from the retainers 560, 570, thereby freeing the hair fastener 200. The hair fastener is then released from retainer hook 582.

Figure 8:
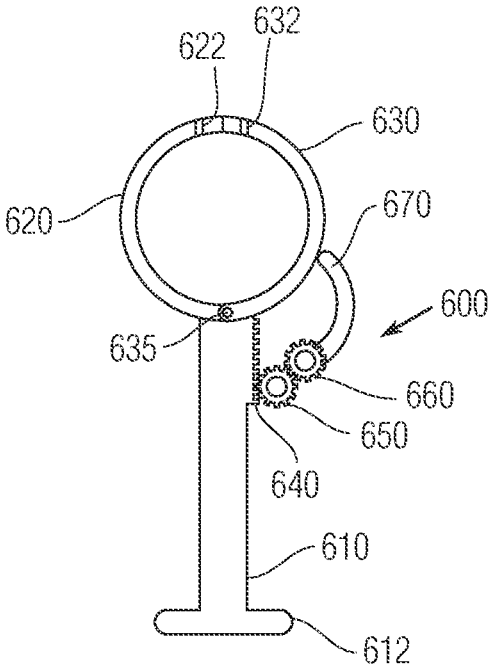
FIG. 8 is a side view of a hair fastener applicator according to one embodiment and being shown in a first position.
Figure 9:
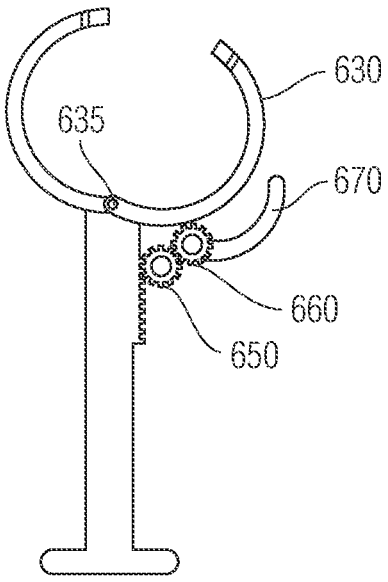
FIG. 9 is a side view of the hair fastener applicator of FIG. 8 in a second position.

FIGS. 8-9 illustrate an actuator 600 (applicator mechanism) for use with a brush, such as the brush 100 shown in FIG. 1. The actuator 600 comprises an elongated mechanism that is intended to, in one position, be stored within a body of the head of the brush. The actuator includes at one end a button 612 that is attached to an elongated shaft 610 (rod). At the other end of the shaft 610 a carrier mechanism is provided for grasping and holding the hair fastener in a releasable manner. The carrier mechanism includes a first part 620 that is fixedly attached to the shaft 610 (and can be in the form of a curved arm) and a second part 630 that is a movable part. In particular, the second part 630 is in the form of a pivotable curved arm that pivots about a pivot 635 (e.g., a hinge). The second part 630 is also biased, as by a spring, such that in a normal rest position, the second part 630 is biased to an open position in which the second part 630 is spaced from the first part 620 so as to define an opening (gap) between the first and second parts 620, 630 to allow the hair bundle to pass therethrough.

The second part 630 is configured such that once it clears the opening in the brush body, the applied biasing force causes the second part 630 to separate from the first part 620.

The actuator 600 is intended to be move in a linear manner within the body of the brush such that the carrier mechanism can be advanced out of the interior of the brush body to a location above the bristles by passing through the opening 140 formed in the brush body. The interior of the brush body can have a track to assist and guide the actuator's movement in a linear manner.

The shaft 610 can be in the form of a rack and therefore, includes a series of teeth 640 formed along one side edge thereof. The shaft and carrier mechanism thus move in a linear manner. At least partially contained within the housing of the brush portion is a closing mechanism 650 for closing the second part 614. The closing mechanism is coupled to the housing and is fixed relative to the movable actuator 600. The closing mechanism is positioned such that the actuator 600 makes contact therewith at a point in which the actuator 600 is moving in the linear manner. More specifically, the closing mechanism includes a first gear 650 that is rotatably mounted to the housing and a second gear 660 that is rotatably mounted to the housing. The second gear 660 is connected to a closing arm 670 that pivots as the second gear 660 rotates. The closing arm 670 has a free end that is configured to contact and drive the second part 670 to a closed position in which the first and second parts 612, 614 are proximate to or in contact with one another, thereby closing the free ends of the hair fastener 200 into a mated (attached) condition.

As the actuator 600 moves in a linear manner in a first direction toward the bristles, the rack teeth 635 make contact with the teeth of the first gear 650 and causes a clockwise rotation thereof. The teeth of the first gear 650 mesh with the teeth of the second gear 660; however, the clockwise rotation of the first gear 650 causes counterclockwise rotation of the second gear 660. Since the closing arm 670 is attached to the second gear 660, the closing arm 670 also moves in a counterclockwise direction such that it is driven into contact with the second part 630 and the continued rotation of the second gear 660 drives the second part 630 to its closed position.

The brush also can include an ejector to eject the hair fastener 200 from the brush after it has been connected about a captured bundle of hair.

In accordance with one or more embodiments, a process for fastening hair with the hair brush 100 is disclosed. Generally, the process begins at a step where the actuator is activated. Activation of the actuator (e.g., via pressing of the actuator by the user) causes the applicator mechanism to advance the hair fastener through the opening. In order to attach the hair fastener to the desired portion of hair, the hair fastener (via the hair fastener applicator mechanism) is advanced above the level of the tips of the bristles 120. In one or more embodiments, continued activation (e.g., continuous pressing) of the actuator causes the hair fastener to continue to move outwardly from the opening 140 and towards the desired portion of hair. As such, in this embodiment, the actuator is deactivated by the user when the hair fastener is advanced the desired height from the opening 140 above the tips of the bristles 120. In at least one embodiment, activation of the actuator does not have to be continuous. In other words, activation of the actuator can be based on a single activation movement (e.g., a single press of the actuator), which can cause the hair fastener to be raised from the opening to a predetermined height above the tips of the bristles. As discussed above, in at least one embodiment, the hair fastener is advanced out of the opening 120 using a spring mechanism.

Once the hair fastener has reached the desired height above the tips of the bristles 120, at a second step, the applicator mechanism pries opens the hair fastener 200 such that the opening of the hair fastener 200 becomes larger in order to accommodate the desired portion (bundle) of hair to be fastened. In embodiments in which the hair fastener 200 has two free ends that are releasably connected, the hair fastener 200 begins in a connected state such that the two free ends are connected to one another. In this embodiment, at the second step, the connected ends are then pried apart (via the applicator mechanism) to result in two free ends and an open end of the hair fastener. In embodiments in which the hair fastener 200 comprises no free ends, at the second step the hair fastener 200 is stretched (via the applicator mechanism) such that the opening of the hair fastener 200 is expanded to a desired size for accommodating the portion of hair to be fastened. In at least one embodiment, the hair fastener 200 is already in an open position when it is advanced out of the opening 140, and as such, in this embodiment, the second step can be skipped.

As discussed above, in certain embodiments the actuator must be continuously activated (e.g., continuously pressed) by the user in order to continue to advance the hair fastener 200 from the opening. As such, in these embodiments, once the actuator is released by the user, the hair fastener stops advancing outwardly from the opening 140. In one or more embodiments, once the hair fastener stops advancing outwardly from the opening 140, the applicator mechanism is configured to pry open the hair fastener. In certain implementations, once the hair fastener stops advancing outwardly from the opening 140, the applicator mechanism automatically begins to pry open the hair fastener. In other embodiments, the applicator mechanism does not begin to pry open the hair fastener mechanism unless the actuator is activated a second time.

At the second step, the "pried open" hair fastener 200 is configured to capture a portion of the user's hair. In one or more implementations, the pried open hair fastener 200 can capture the desired portion of hair via manual movement of the hair brush 100 by the user. Said differently, the user can manipulate the position of the hair brush 100 with the pried opened hair fastener 200 such that the portion of hair the user desires to fasten is confined within the opening of the hair fastener 200.

Once the desired portion of hair to be fastened has been confined within the opening of the pried open hair fastener, at a third step, the applicator mechanism is configured to release and close the hair fastener 200 such that the hair fastener 200 securely fastens the confined portion of hair. In one or more embodiments, the applicator mechanism is configured to release and close the hair fastener 200 around the hair upon deactivation of the actuator. In at least one embodiment, activation of the actuator causes the release of the hair fastener 200.

In implementations in which the hair fastener 200 comprises two free ends with complementary connectors (e.g., snap fit, hook and loop, magnet), the third step of releasing the hair fastener also includes re-connecting the two free ends of the connectors in order to securely fasten the desired portion of hair. For example, in an implementation in which the two free ends are complementary magnets, when the applicator mechanism releases the hair fastener, the complementary magnets will attract one another and thus reconnect due to their magnetic fields. In an implementation in which the two free ends are either male and female snap-fit connectors, respectively or hook and loop fasteners, in addition to releasing the hair fastener the applicator mechanism is configured to rotate one free end of the hair fastener 200 toward the other free end such that they securely connect with one another and thereby securely fasten the desired portion of hair.

The process described above can optionally be repeated for other portions of the user's hair. It should be understood that although much of the foregoing description has been directed to devices and methods for applying a hair fastener, the devices and methods disclosed herein can be similarly deployed and/or implemented in scenarios, situations, and settings far beyond the referenced scenarios.

Hair Fastener Cartridge

It will also be understood that a cartridge can be provided and contains multiple hair fasteners. The cartridge can be spring loaded so that a biasing force is applied to a stack of fasteners arranged in a side-by-side manner. For example, the cartridge can contain a housing that has a movable wall that is biased by a spring. To insert a pack of hair fasteners, the wall is moved with a person's finger resulting in compression of the spring. Then the pack of hair fasteners is loaded (inserted) into the housing and the movable wall is released. As each hair fastener is advanced and discharged from the cartridge, the next in time hair fastener is advanced to a loaded position and is ready to be applied to the hair.

Hair Brush with Integral Hair Fastener Applicator

Figure 13:
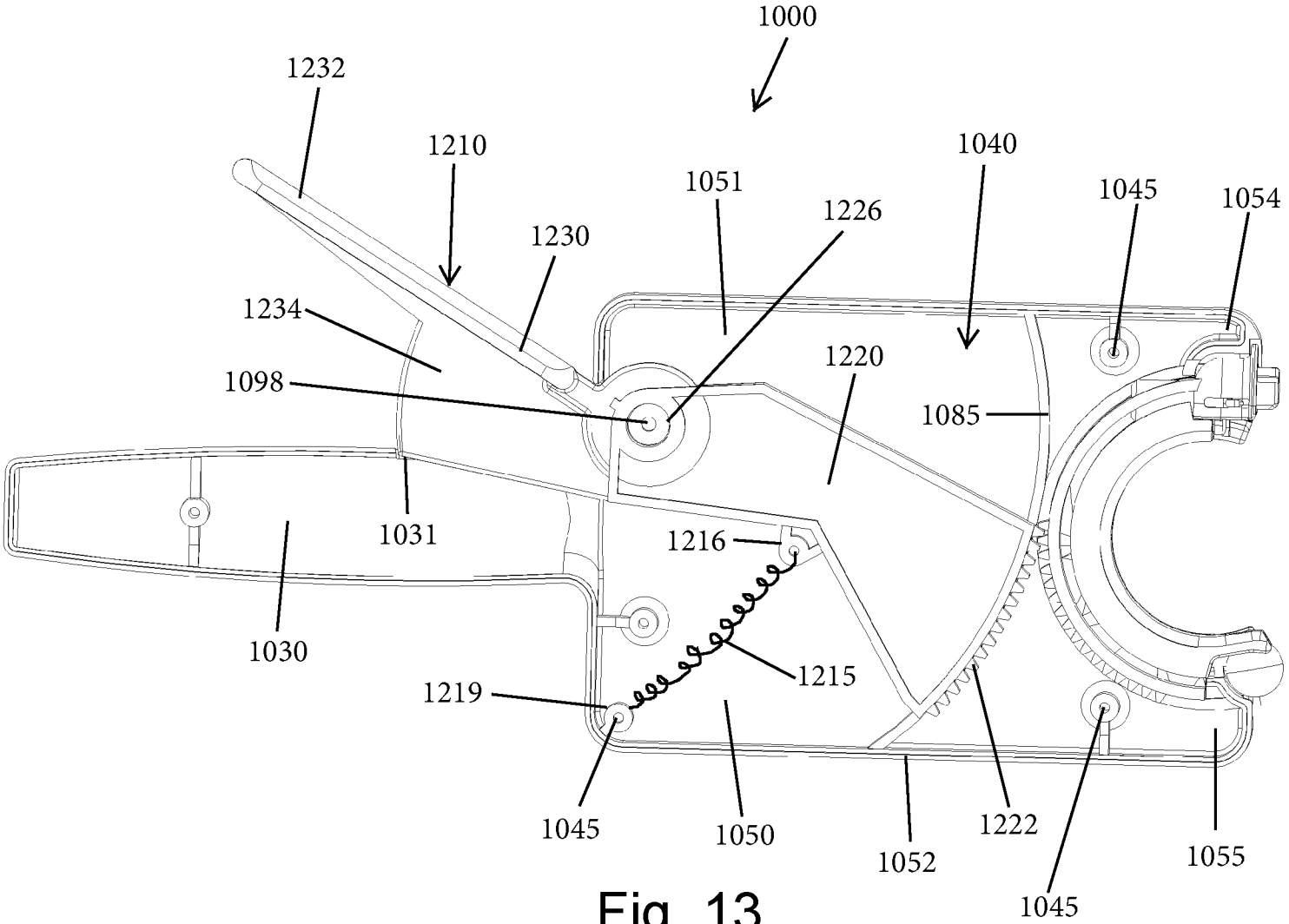
FIG. 13 is a rear elevation view thereof with one half of the housing being removed to show some of the internal components.
Figure 14:
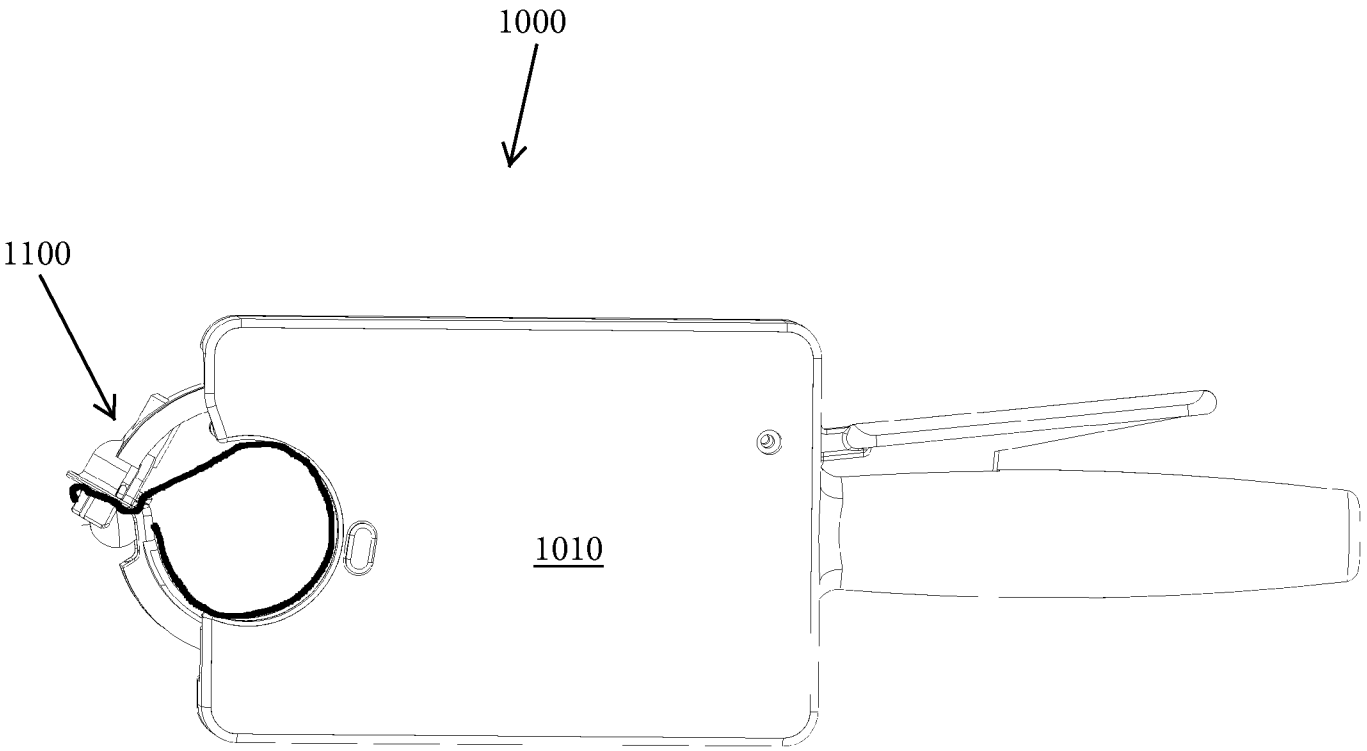
FIG. 14 is a front elevation view showing the hair brush with integral hair fastener applicator in a closed position.
Figure 15:
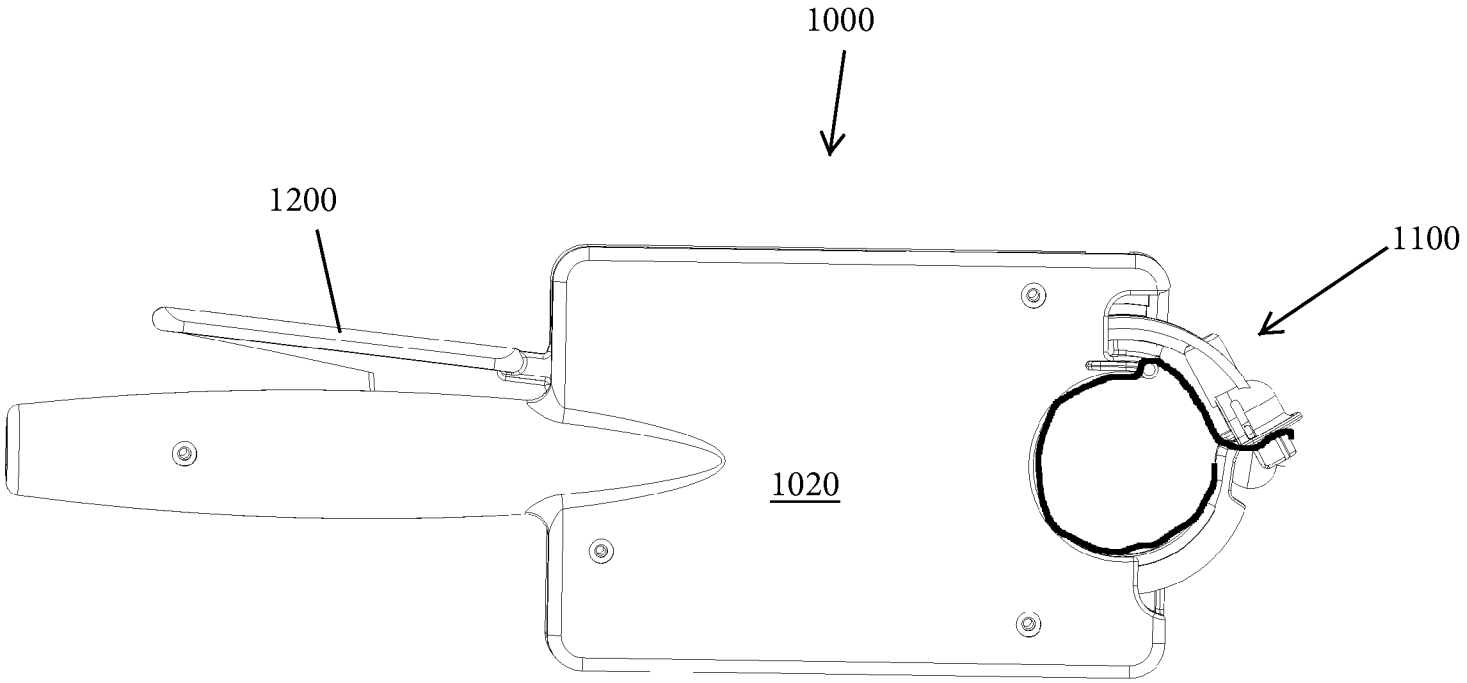
FIG. 15 is a rear elevation view thereof.

FIGS. 10-26B show various aspects of a hair brush 1000 according to another exemplary embodiment. The hair brush 1000 includes an integral hair fastener applicator mechanism 1100 ("applicator mechanism"). The hair brush 1000 has a first end 1002 and an opposite second end 1004 as well as a first face 1010 and an opposing second face 1020. The hair brush 1000 has a defined handle portion 1030 and a main brush portion 1040. As shown, the handle portion 1030 is an elongated portion that is intended to be grasped by the user and an actuator 1200 is also provided as part of the handle portion 1030. As described herein, the actuator 1200 is the means by which the hair fastener applicator mechanism 1100 is operated. The actuator 1200 at rest is in a fully extended position shown in FIG. 10, while upon actuation, the actuator 1200 assumes a retracted position as shown in FIG. 14.

The hair brush 1000 has a housing that is formed of a first housing part 1050, which can be thought of as being an upper housing part, and a second housing part 1060, which can be thought of as being a lower housing part. As shown, the first housing part 1050 can be one half of the housing and the second housing part 1060 can be the other half of the housing. Accordingly, each of the first housing part 1050 and the second housing part 1060 includes one handle portion 1030 and one main brush portion 1040.

The two parts 1050, 1060 can be joined together using conventional techniques, such as the use of fasteners (e.g., screws). As shown, a plurality of threaded coupling members 1045 (e.g., threaded bosses) can be provided to mate with the fasteners for attaching the two parts 1050, 1060 together. When attached together, the two parts 1050, 1060 close off the hollow interior space that is defined within each of the parts 1050, 1060.

As shown, the first housing part 1050 is defined by a first outer wall 1051 and a peripheral side wall 1052 that extends around the periphery of the first outer wall 1051. As shown, the peripheral side wall 1052 can be formed perpendicular to the first outer wall 1051. The handle portion 1030 extends outwardly from a proximal end of the main brush portion 1040, while a distal end of the main brush portion 1040 can include a curved profile. More specifically and as illustrated, the distal end of the main brush portion 1040 of the first housing part 1050 (i.e., second end 1004) has an arcuate (e.g., semi-circular) notch or cutout 1053 formed therein which serves to define a first distal portion 1054 on one side of the cutout 1053 and a second distal portion 1055 on the other side of the cutout 1053. The first distal portion 1054 is thus located along one side of the main brush portion 1040, while the second distal portion 1055 is located along the other side of the main brush portion, both at the distal end thereof.

Figure 17:
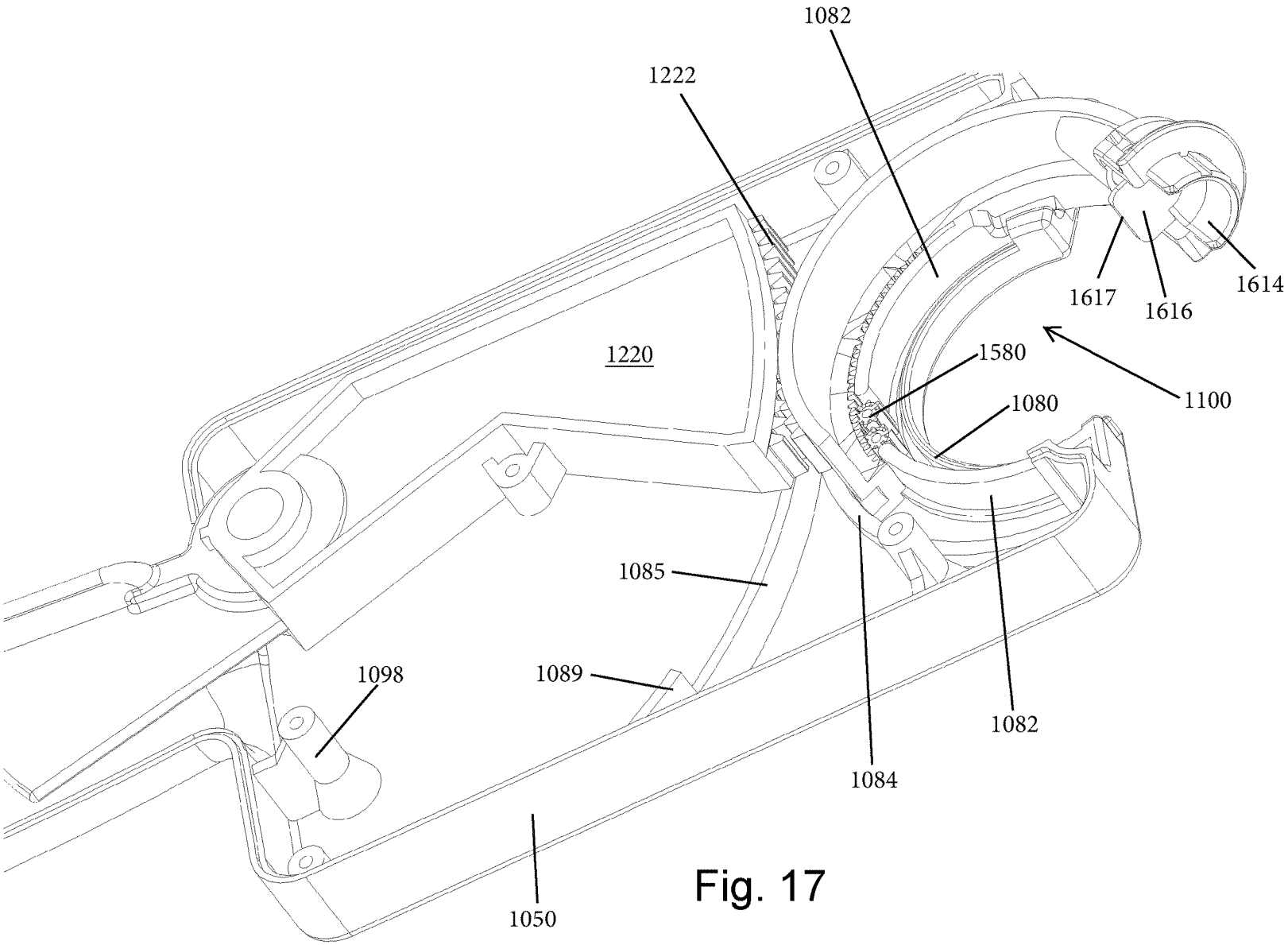
FIG. 17 is a partial perspective view with one half of the housing being removed to show internal components.
Figure 18:
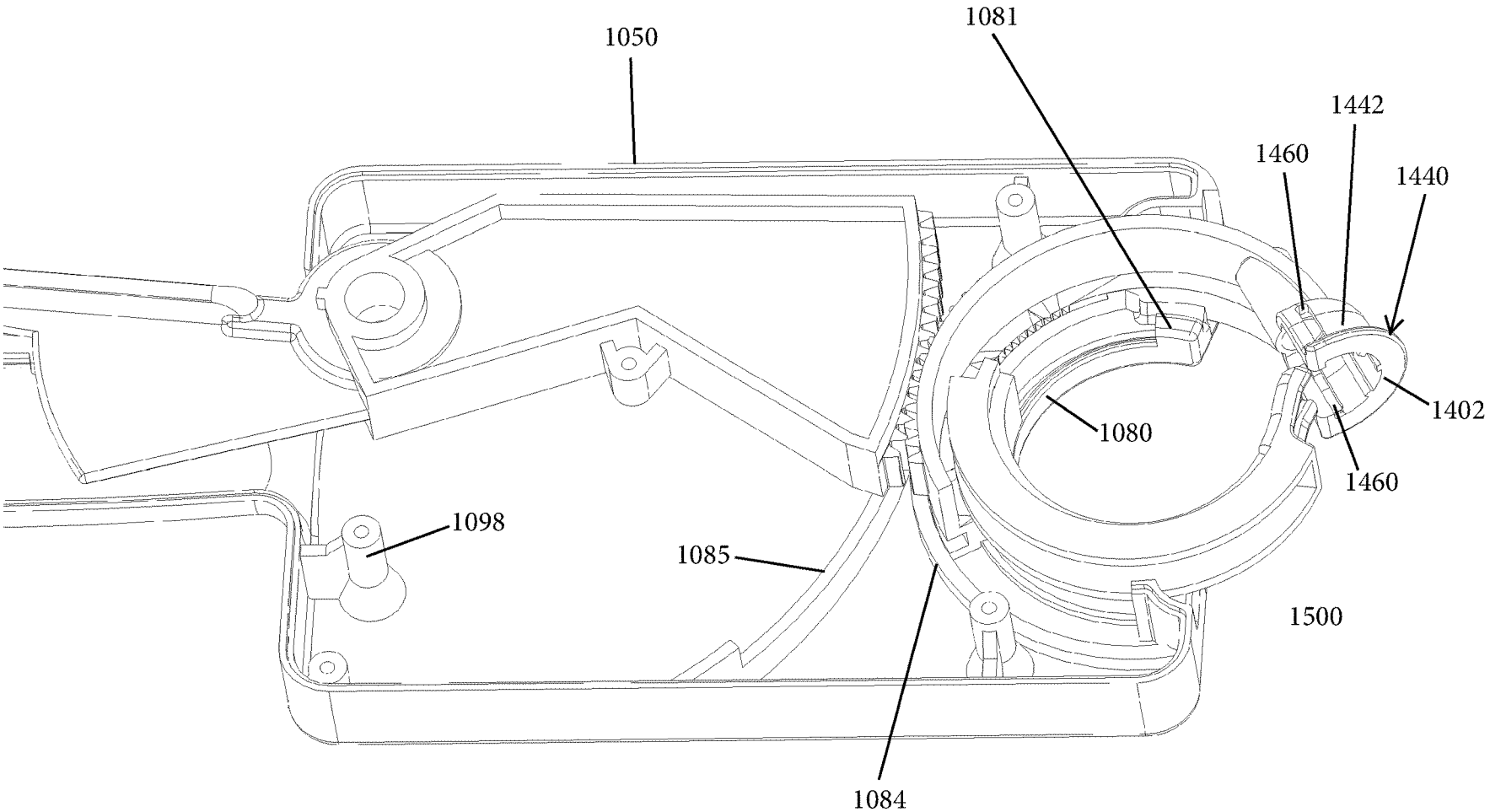
FIG. 18 is a partial perspective view with one half of the housing being removed to show internal components.
Figure 19:
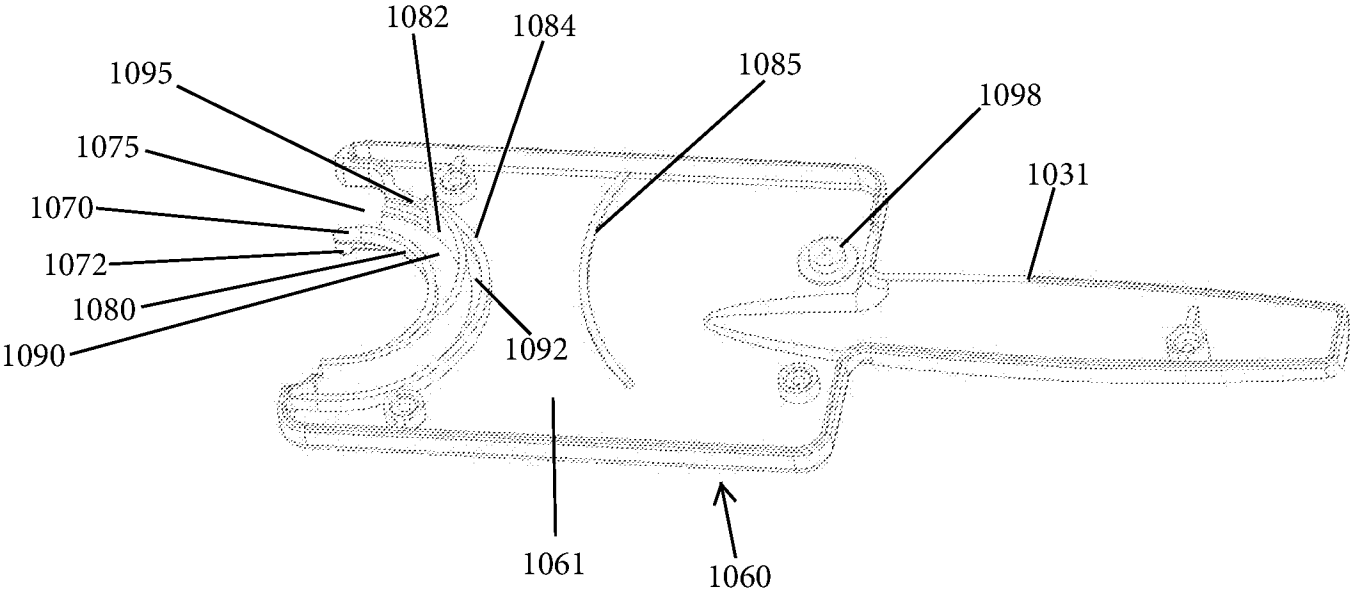
FIG. 19 is a perspective view of one half of the housing with the internal components being removed for sake of clarity.
Figure 20:
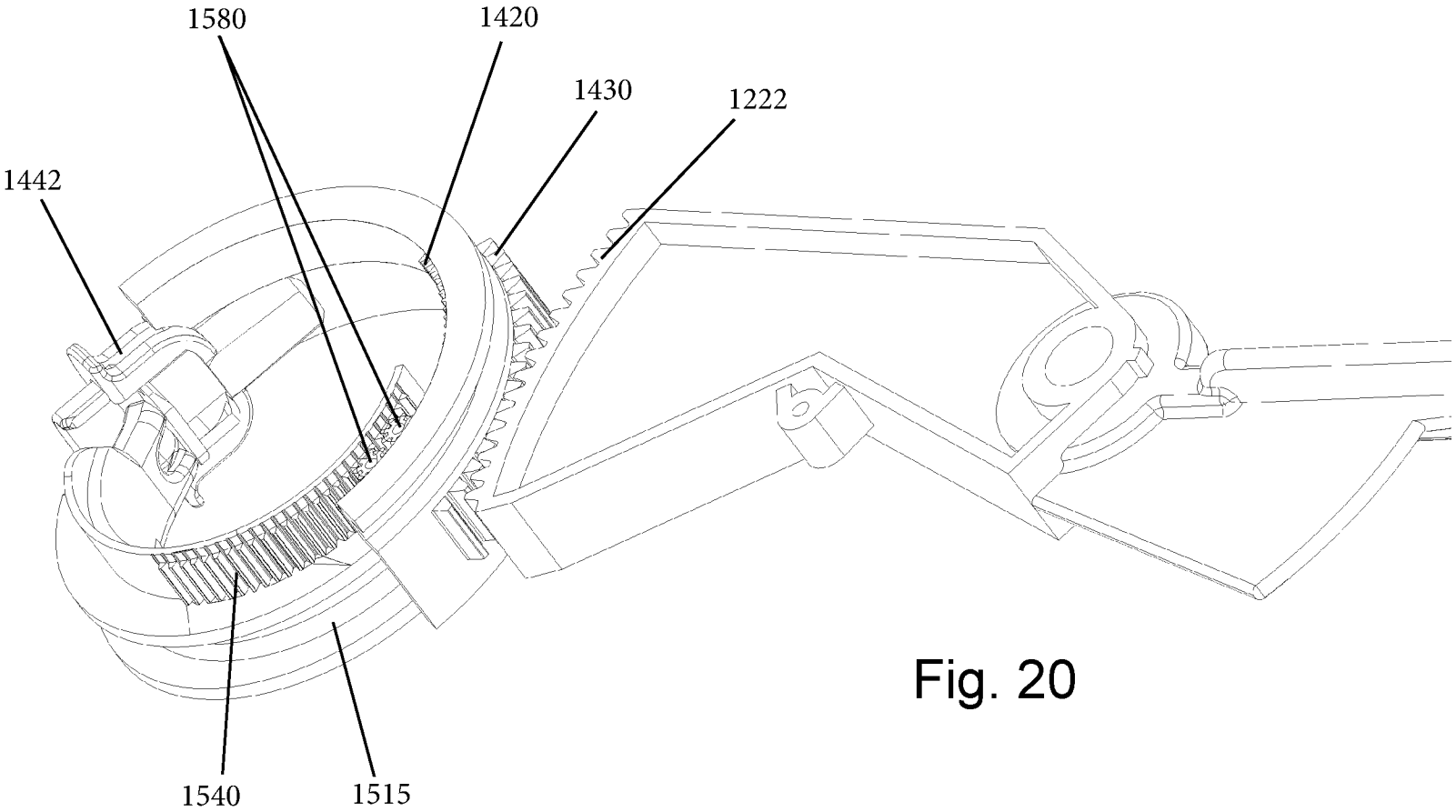
FIG. 20 is a perspective view of certain internal components of the applicator mechanism.
Figure 21:
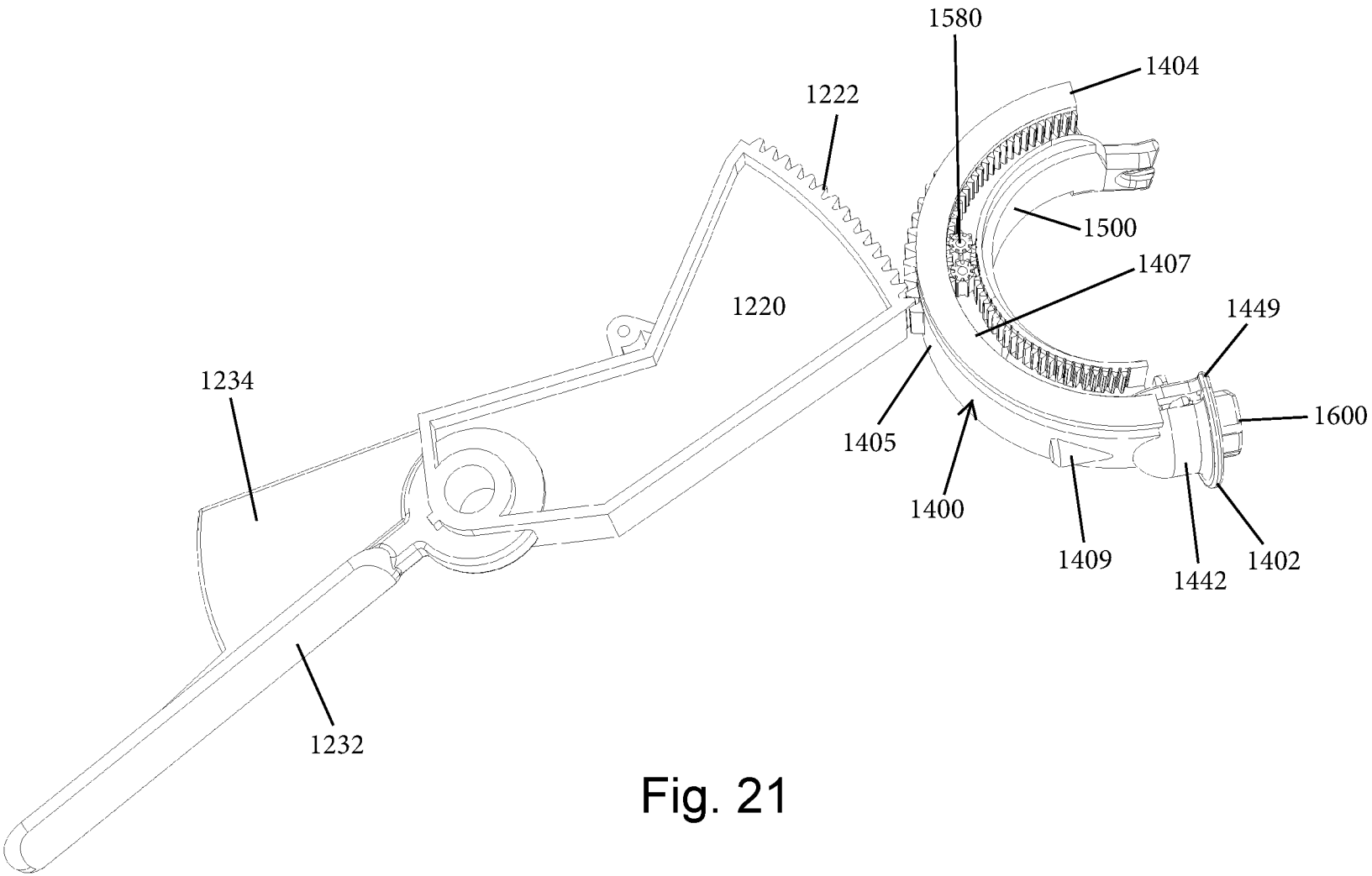
FIG. 21 is a perspective view of certain internal components of the applicator mechanism.
Figure 22:
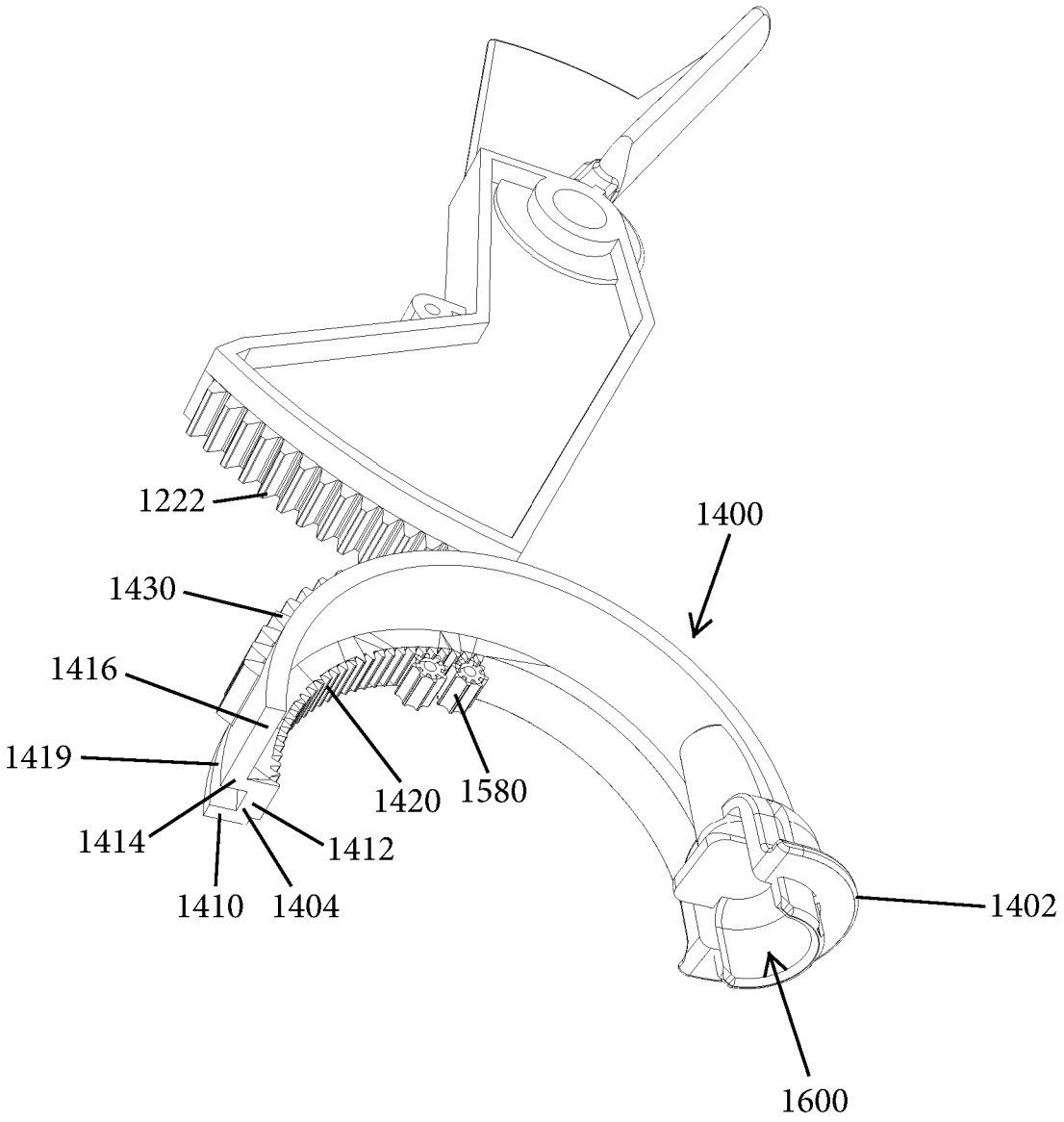
FIG. 22 is a perspective view of certain internal components of the applicator mechanism.
Figure 23:
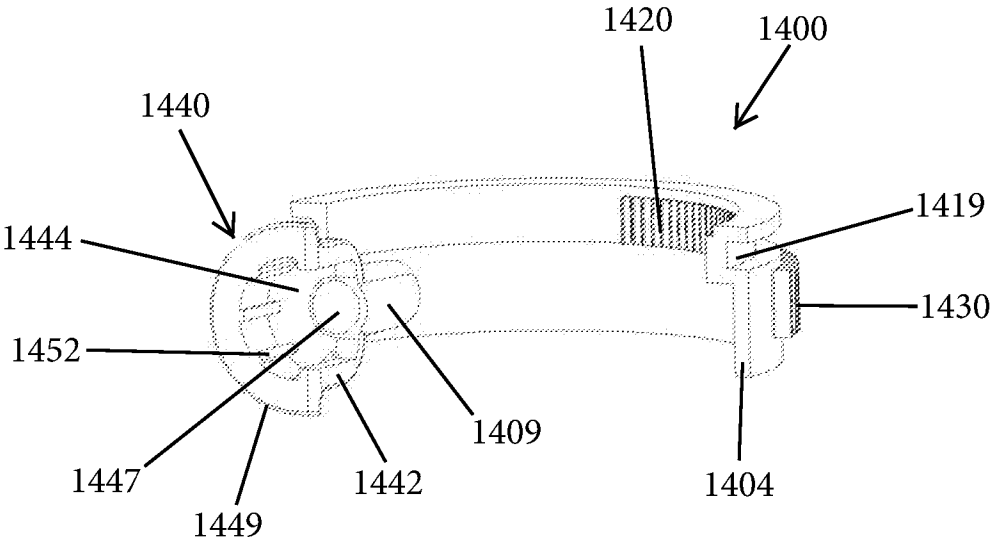
FIG. 23 is a perspective view of a first arm of the applicator mechanism.
Figure 24:
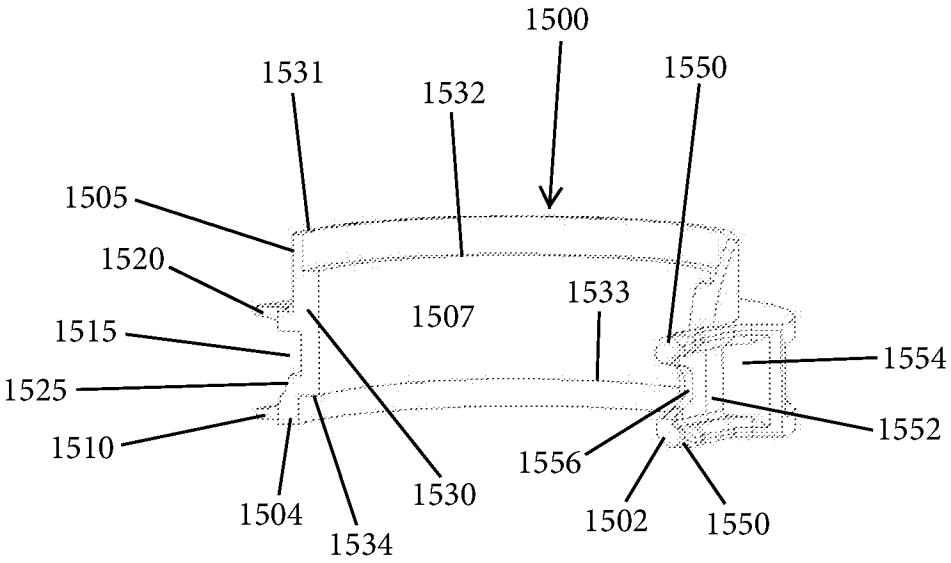
FIG. 24 is a perspective view of a second arm of the applicator mechanism.
Figure 25:
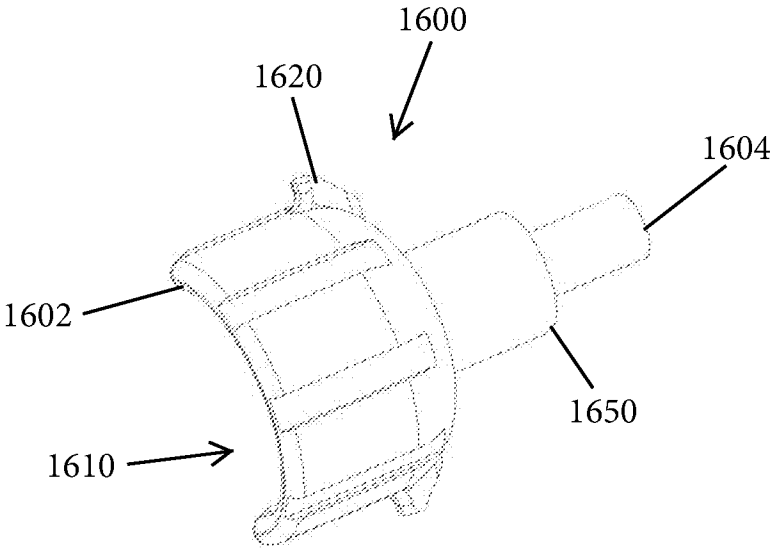
FIG. 25 is a perspective view of a cup of the applicator mechanism.

As shown in FIG. 19, the second housing part 1060 also includes a guide track arrangement that is formed by a series of arcuate shaped walls that are spaced apart from one another. As shown, the guide track arrangement can be defined by a first guide track wall 1080, a second guide track wall 1082, and a third guide track wall 1084. The first guide track wall 1080 is located right at the edge of the cutout 1053 and thus is the distalmost wall of the three guide track walls. The second guide track wall 1082 is the middlemost guide track wall, while the third guide track wall 1084 represents the proximalmost wall of the three guide track walls. As a result of this construction, a first guide track 1090 is formed between the first guide track wall 1080 and the second guide track wall 1082 and a second guide track 1092 is formed between the second guide track wall 1082 and the third guide track wall 1084. Each of the first guide track 1090 and the second guide track 1092 has an arcuate shape in the illustrated embodiment. It will be appreciated that, as shown in FIGS. 13, 17 and 18, the first housing part 1050 has a complementary structure in terms of guide track walls and guide tracks in that the first housing part 1050 has the first guide track wall 1080, the second guide track wall 1082 and the third guide track wall 1084 which define guide tracks 1090, 1092. The second guide track wall 1082 has a split construction as shown in FIG. 17 with respect to the first housing part 1050.

It will be appreciated that the shapes of the first, second and third guide track walls 1080, 1082, 1084 generally mirror the shape of the cutout 1053. In other words, their shapes can be generally semi-circular. Also, the heights of the three guide track walls 1080, 1082, 1084 can vary. As shown, the second guide track wall 1082 can be taller than the first guide track wall 1080 and the third guide track wall 1084 as shown.

One end of each of the second guide track wall 1082 and the third guide track wall 1084 can be of a reduced height so as to define an area 1095 that extends from the edge of the cutout 1053 to vertical edges of the second and third guide track walls 1082, 1084.

The first housing part 1050 also includes a pivot 1098 which can be in the form of a cylindrical shaped structure that protrudes outwardly from the first outer wall 1051. The pivot 1098 is located at the proximal end of the main brush portion.

The first housing part 1050 also includes a finger structure (finger) 1070 that extends outwardly from the distal end of the first housing part 1050. At the free end of the finger 1070, there is a post 1072, such as a round post. A space 1075 is formed between the finger 1070 and the second distal portion 1055. The finger 1070 is generally aligned with the first guide track wall 1080.

The hair fastener applicator mechanism 1100 is generally the mechanism which is controlled by the actuator 1200 is configured such that when operated, a hair fastener 70 can be wrapped around and secured to a bundle of hair. As shown in the figures, the hair fastener 70 is of a type that can be formed of any number of different materials, including polymeric materials, and has a degree of elasticity as described herein. The hair fastener 70 has a ball 71 at a first end and has a loop 72 at the opposite other end (See, FIG. 26B). The loop 72 can be formed by looping the end of the elongated portion of the hair fastener and connecting it to itself, as by a knot, etc. In a rest position, the loop 72 and the hollow space defined therein can have a tear drop shape. It will be appreciated that the hair fastener 70 can come in any number of different colors and textures. The hair fastener 70 is sized to operate with the hair fastener applicator mechanism 1100 as described herein.

The actuator 1200 includes a pivotable trigger 1210 that is pivotally coupled to the housing. The trigger 1210 includes a first portion (distal end portion) 1220 that disposed internally within the main brush portion 1040 of the housing and a second portion 1230 that is disposed external to the main brush portion 1240. The first portion 1220 terminates in a distal end that includes a plurality of gear teeth 1222. The distal end is a curved surface and can be formed at the end of a wedge shaped section of the first portion 1220. The first portion 1220 thus can be thought of as being a fan gear. A proximal end 1223 of the first portion 1220 includes a hole 1226 through which the pivot 1098 is disposed. Thus, an axis of the hole 1226 and the pivot 1098 define a pivot point about which the trigger 1210 pivots (rotates).

The second portion 1230 includes a blade section 1232 that extends outwardly from the main brush portion 1040 of the housing and a fan section (web) 1234 that extends radially outward from the blade section 1232 in a direction toward the handle portion 1030. As shown, the handle portion 1030 of at least one of the first housing part 1050 and the second housing part 1060 includes a notch 1031 that is formed along one side of the handle portion 1030. In the illustrated embodiment, the first housing part 1050 includes notch 1031, while the second housing part 1060 does not. When the first housing part 1050 and the second housing part 1060 mate together, the notch 1031 defines a slot or opening into which the fan section 1234 is received during operation of the trigger 1210. For example, as the trigger 1210 is squeezed and moves toward the handle portion 1030, the fan section 1234 enters into the slot (notch 1031) and the degree of which the fan portion 1234 is disposed within the slot and disposed within the hollow interior of the handle portion 1030 depends upon the location of the trigger 1210 relative to the handle portion 1030. For example, the greater degree of which the trigger 1210 is depressed (squeezed), the greater degree of which the fan section 1234 is contained within the handle portion 1030. It will be understood that the fan section 1234 is an anti-pinch feature in that the provision of the fan section 1234 in this location, prevents a hand/finger of the user from being pinched between the blade section 1232 and the fan section 1234. As shown, the thickness of the blade section 1232 can be greater than the thickness of the fan section 1234.

The trigger 1210 comprises a biased member in that the trigger 1210 is biased to assume an open (fully extended) position as a normal at rest position. In the open position (FIG. 10), the blade section 1232 and fan section 1234 are spaced a maximum distance from the handle portion 1030 of the housing. Squeezing the trigger 1210 causes the trigger 1210 to move to a closed (fully retracted) position. A biasing member 1215, such as an extension spring, can be provided for applying a biasing force to the trigger 1210 to cause the trigger 1210 to assume the fully extended position in a rest position. A first end of the spring 1215 can be coupled to a first coupling member 1216 that is part of the first portion 1220 of the trigger 1210. The first coupling member 1216 can be in the form of a protrusion that extends outwardly from one side edge of the first portion 1220 and has a hole formed therein through which the spring 1215 is passed. A second end of the spring 1215 is coupled to a second coupling member 1219 that is formed as part of one of the first housing part 1050 and the second housing part 1060. The second coupling member 1219 can be in the form of a protrusion to which the second end of the spring 1215 is secured. The spring 1215 thus serves to pull the trigger 1210 to the corner of the main brush portion 1040 in which the second coupling member 1219 is located. Conversely, when the trigger 1210 is fully retracted, the spring 1215 is extended (stretched) and stores energy. Once the trigger 1210 is released, the stored energy of the spring 1215 is released causing the trigger 1210 to pivot back to the fully extended (open) position.

There can be a raised rail 1085 formed along the inner face of the outer wall 1051 of the first housing part 1050 to assist in guiding the first portion 1220 and in particular, the distal end 1221 thereof, as the trigger 1210 makes its sweeping movement between the open position and the closed position. The raised rail 1085 is curved in an opposite direction relative to the direction of curvature of the walls 1080, 1082, 1084.

The actuator 1200 includes movable arms that are operatively coupled to the trigger 1210 as described herein and move between an open position (FIG. 10) (at rest position) and a closed position (FIG. 14). More specifically, the actuator 1200 includes a first arm 1400 that has an arcuate shape and includes a first end 1402 and an opposite second end 1404. The first arm 1400 is thus defined by a body that has a first face 1401, an opposing second face 1403, an inner face 1405 and an opposing outer face 1407. The inner face 1405 faces the handle portion 1030, while the outer face 1407 faces the cutout 1053 of the housing. The body of the first arm 1400 is defined by a first wall 1410, a second wall 1412 that is perpendicular to the first wall 1410 and extends outwardly therefrom, a third wall 1414 that is perpendicular to the second wall 1412 and is parallel to but radially offset from the first wall 1410 and a fourth wall 1416 that is parallel to the second wall 1412 but axially offset therefrom. A right shoulder is thus formed between the first wall 1410 and the second wall 1412 and an arcuate shaped slot or space 1419 is formed between the second wall 1414 and the fourth wall 1416.

Along the inner face of the first wall 1412, a first set of teeth 1420 is formed. The first set of teeth 1420 are thus formed along an arc of the first arm 1400 and do not extend completely from the first end 1402 to the second end 1404. Along an outer face 1407 of the fourth wall 1416, a second set of teeth 1430 is formed. The second set of teeth 1430 are thus formed along an arc of the second arm 1400 and do not extend completely from the first end 1402 to the second end 1404.

At the first end 1402 of the first arm 1400, a socket 1440 is formed. The socket 1440 is generally semi-circular shaped and is defined by a semi-circular shaped side wall 1442 and a floor 1444 that extends between the side wall 1442. The floor 1444 includes a hole 1447 that can be cylindrically shaped as shown. As shown, the body of the first arm 1400 can have a thicker portion 1409 to accommodate the cylindrically shaped hole 1447. In particular, the thicker portion 1409 can be a semi-circular portion protruding from one side of the first side wall 1442 and another semi-circular portion protruding from the other side of the first side wall 1442 so as to define the cylindrically shaped hole 1447. Since the socket 1440 is semi-circular shaped, the socket 1440 is open in a direction toward the cutout 1053 of the housing.

The free distal end 1441 of the socket 1440 has a flange 1449 that is also semi-circular shaped and extends outwardly from the side wall 1442. In particular, the flange 1449 is formed at a right angle to the side wall 1442. The flange 1449 also has a flat outer surface that can be thought of as defining a landing.

Along the inner surface of the side wall 1442, a plurality of ribs 1452 can be formed. The ribs 1452 are spaced apart from one another.

The socket 1440 also includes one or more slots 1460 formed therein. For example, two slots 1460 can be formed and oriented generally opposite one another.

The actuator 1200 further includes a second arm 1500 that like the first arm 1400 has an arcuate shape and includes a first end 1502 and an opposite second end 1504. The second arm 1500 is thus defined by a body that has an inner face 1505 and an opposing outer face 1507. The inner face 1505 faces the handle portion 1030, while the outer face 1507 faces the cutout 1053 of the housing. The body of the second arm 1500 generally has a stepped construction with a first flange 1510 extending radially outward and defining a first face. The body also includes a second flange 1520 that also extends radially outward and is spaced from the first flange 1510. Between the first flange 1510 and the second flange 1520 is an arcuate shaped groove or track 1515 that defines part of the inner face 1505. A third flange 1525 can also be formed and located between the first flange 1510 and the second flange 1520. As shown, the first and second flanges 1510, 1520 can extend outward the same radial distance (i.e., the edges of each overlap one another), while the third flange 1525 has a shorter radial distance that it extends as shown. A step is thus formed between the third flange 1525 and the first flange 1510.

As shown in figures, the first and second flanges 1510, 1520 can be thought of as extending radially outward from a main wall portion 1530. The main wall portion 1530 defines the inner face 1505 and the outer face 1507. One end 1531 of the main wall portion 1530 has a reduced thickness, thereby forming a first shoulder 1532 along the outer face 1507. There is also a second shoulder 1534 formed near the other end 1533 of the main wall portion 1530 so as to create a center band between the two shoulders 1532, 1534.

Along the inner face 1505 between the second flange 1520 and the end 1531 a plurality of teeth 1540 are formed.

Since the inner face 1505 has an arcuate shape, the teeth 1540 likewise ware formed in an arcuate manner.

When the first arm 1400 and the second arm 1500 are assembled within the housing, the teeth 1540 of the second arm 1500 face the teeth 1420 of the first arm 1400. The teeth 1540 and teeth 1420 are coupled to one another by means of a gear pinion 1580 and more specifically, a pair of rotatable gear pinions 1580 are provided to allow the motion of the first arm 1400 to be directly translated into motion of the second arm 1500. Each gear pinion 1580 is mounted to the housing by means of a fixed post about which the gear pinion can freely rotate.

At the first end 1502 of the second arm 1500, a fork structure is formed in that there is a pair of fingers 1550 that are spaced apart from one another with a web 1552 being formed between the fingers 1550. The fingers 1550 are upstanding relative to the web 1552 in that the fingers 1550 protrude outwardly from the web 1552. The web 1552 extends to an end wall 1554 that extends from the first flange 1510 to the second flange 1520. The web 1552 can be thought of as defining a flat surface between the pair of fingers 1550. Within the web 1552, a slot 1556 is formed and is open as the distal ends of the pair of fingers 1550. As shown, the slot 1556 can generally be U-shaped; however, other shapes are equally possible.

A cup 1600 is provided and is intended to mate with and move axially with respect to the first arm 1400. The cup 1600 is formed of a body that has a first end 1602 and an opposing second end 1604. A main cup portion 1610 of the cup 1600 is formed at the first end 1602. The main cup portion 1610 has an arcuate shaped side wall 1614 and a floor or end wall 1616. The side wall 1614 can be approximately semi-circular in shape and extends outwardly from a peripheral edge of the floor 1616. The side wall 1614 is thus located along a portion of the floor 1616; however, there are other portions of the floor 1616 that do not contain the side wall 1614 and are thus open. The floor 1616 preferably has a planar surface and one edge 1617 of the floor 1616 can be flat (linear). The edge 1617 is opposite the side wall 1614. The combination of the side wall 1614 and floor 1616 define an interior space that is configured to hold the fastener as described herein.

The side wall 1614 also includes one or more and preferably a plurality of tabs 1620 that extend outwardly therefrom. The tabs 1620 are disposed opposite (180 degrees) one another. The tabs 1620 can be formed along the side wall 1614 near or at the location where the side wall 1614 joins the floor 1616. As described herein, the tabs 1620 are configured to be inserted into the slots 1640 to couple the cup 1600 to the socket 1440 and permit the cup 1600 to move axially with respect to the socket 1440.

The cup 1600 also includes a post portion 1650 that extends to the opposing second end 1604. The post portion 1650 extends outwardly from the bottom of the main cup portion 1610. The post portion 1650 can be in the form of two concentric posts that each has a cylindrical shape with the outer post having a reduced diameter. The post portion 1650 is configured for reception into the hole 1447 that is formed in the floor 1444. The cup 1600 is biased in that a biasing element, such as a spring, is disposed about the post portion 1650.

The post portion 1650 and the spring disposed thereabout are received within the cylindrically shaped hole 1447 and the spring is constrained within the hole 1447 such that is applied a biasing force to the cup 1600 in an outward direction so as to cause the cup 1600 to be in the fully extended (biased) position. In this position, the tabs 1620 can be located at or near first ends of the slots 1640. Conversely, when a force is applied to the cup 1600, the spring compresses and the tabs 1620 travel within the slots 1640. The slots 1640 thus act as guide slots that help guide the cup 1600 relative to the socket. The cup 1600 is thus coupled to the socket 1440 and moves axially therein as part of a hair fastener release step as discussed herein.

Along an outer surface of the main cup portion 1610, one or more ribs 1611 can be formed so as to spaced apart from one another.

Storage Compartment

Figure 26A:
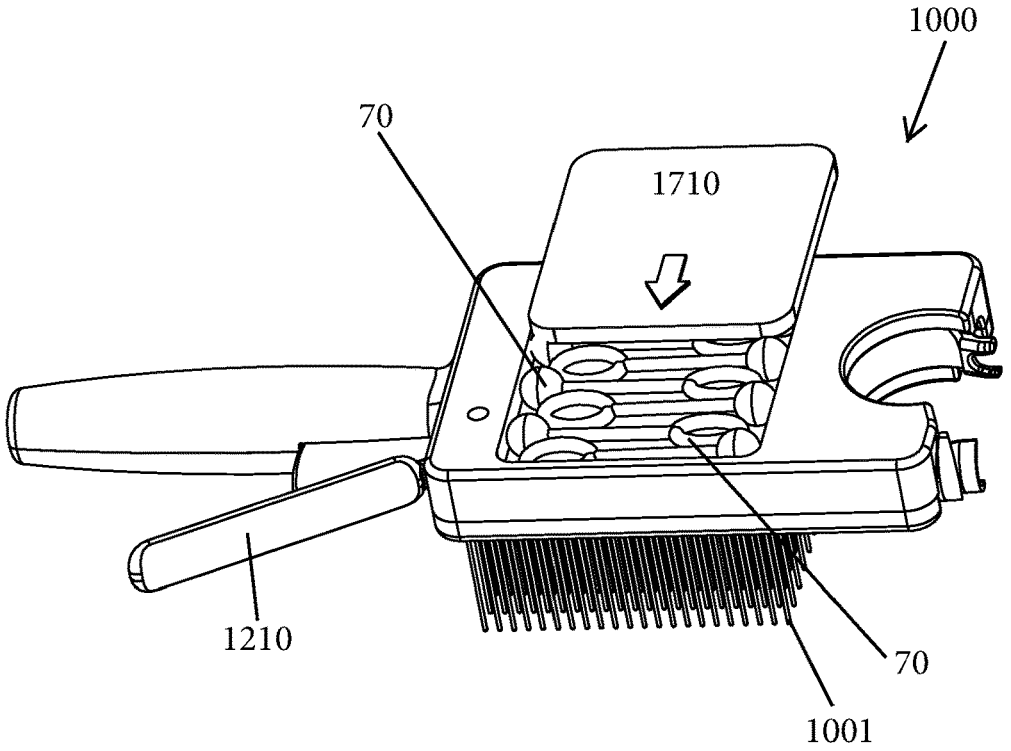
FIG. 26A is a perspective view showing an internal storage compartment for storing a plurality of hair fasteners.
Figure 26B:
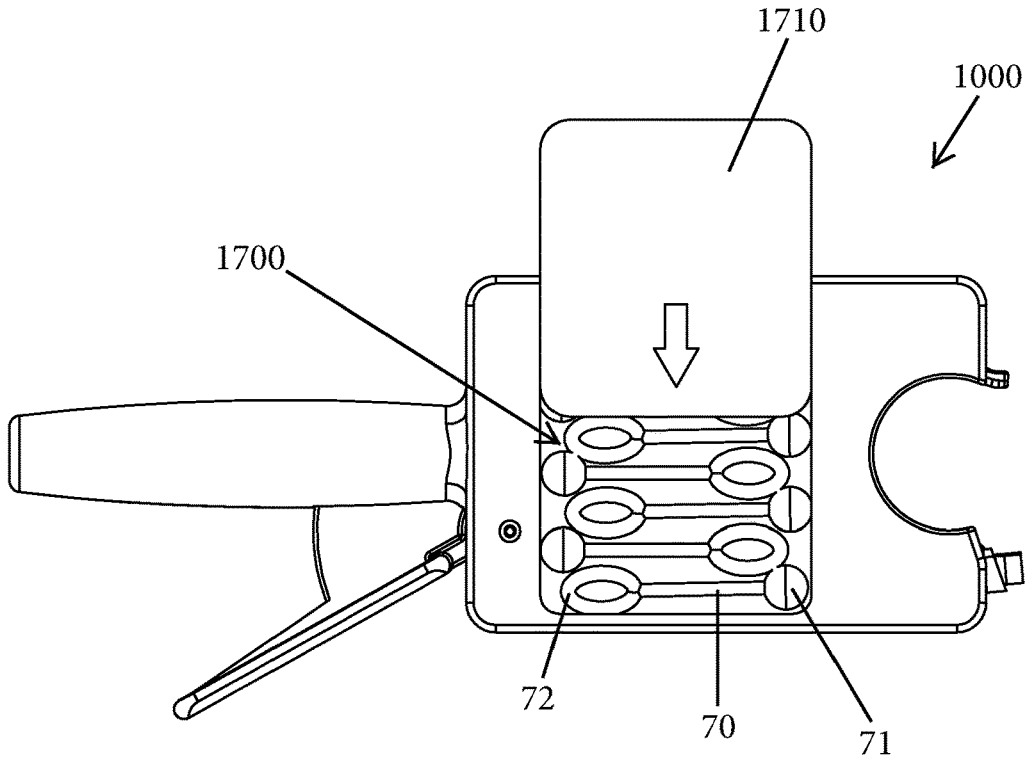
FIG. 26B is a front elevation view thereof.

As shown in FIGS. 26A and 26B, according to one embodiment, the hair brush 1000 can include a storage compartment 1700 that is configured to store a plurality of hair fasteners, such as hair fasteners 70. The storage compartment 1700 can be formed in one of the housing parts. A removable cover 1710 covers the compartment 1700 in a closed position. A snap-fit type of attachment can be provided between the cover 1710 and the housing. As shown, the hair fastener 70 is of the type that includes ball 71 at one end and loop 72 at the other end. The hair fastener 70 is formed of any number of suitable materials, such as synthetics, and has a degree of elasticity.

Assembly of the Hair Brush 1000

The integral hair fastener applicator mechanism 1100 is assembled between the first housing part 1050 and the second housing part 1060 in the following manner.

The first arm 1400 is disposed within the second guide track 1092 that is formed between the second guide track wall 1082 and the third guide track wall 1084. This permits the first arm 1400 to undertake a sweeping motion within the second guide track 1092 in response to the driving action of the actuator 1200. As shown and as previously discussed, the actuator 1200 is pivotally coupled to and partially contained within the housing. The distal end of the first portion 1220 rides along the guide rails 1085 formed as part of both the first housing part 1050 and the second housing part 1060. As best shown in FIG. 17, at one end of the rail 1085, a stop 1089 is provided to limit the degree of travel of the first portion 1220 of the trigger 1210. When the first arm 1400 is disposed within the second guide track 1092, the teeth 1430 of the first arm 1400 mesh with the teeth 1222 formed at the distal end of the first portion 1220. As a result, when the pivotable trigger 1210 is depressed, the trigger 1210 pivots in a first direction and because of the geared connection between the trigger 1210 and the first arm 14, the first arm 1400 is also driven and pivots in the first direction. This pivoting of the first arm 1400 in the first direction causes the first arm 1400 to move from the closed position (retracted position) (FIG. 10) to the open position (extended position) (FIG. 14). Conversely, when the trigger 1210 is released and return spring 1215 causes the trigger 1210 to return to the rest position, the trigger 1210 pivots in an opposite second direction and this motion is translated into the first arm 1400 also pivoting in the opposite second direction.

As shown in the figures, the gear pinions 1580 serve to couple the first arm 1400 to the second arm 1500. The gear pinions 1580 are fixedly attached to the housing by means of posts that allow rotation of the gear pinions 1580. The teeth 1420 of the first arm 1400 mesh with the gear pinions 1600 and likewise, the gear pinions 1600 mesh with the teeth 1540 of the second arm 1500. When the first arm 1400 pivots in the first direction, the rotation of the gear pinions 1600 causes rotation of the second arm 1500 in the opposite second direction. The second arm 1500 is disposed within the first guide track 1090 that is formed by the first guide track wall 1080 and the second guide track wall 1082. As shown in FIG. 18, a stop 1081 can be formed at one end of the first guide track 1090 to limit the degree of travel of the second arm 1500 within the first guide track 1090. Thus, when the trigger 1210 is depressed, the first arm 1400 and the second arm 1500 pivot in opposite directions which results in the first arm 1400 and the second arm 1500 moving from the open (fully retracted) position (FIG. 10) to the close (fully extended) position (FIG. 14). Conversely, when the trigger 1210 is released, the first arm 1400 and second arm 1500 move again in opposite directions so as to return back to the open (fully retracted) position.

The operation of the hair fastener applicator mechanism 1100 is discussed below.

Operation of the Hair Fastener Applicator Mechanism

Figure 10:
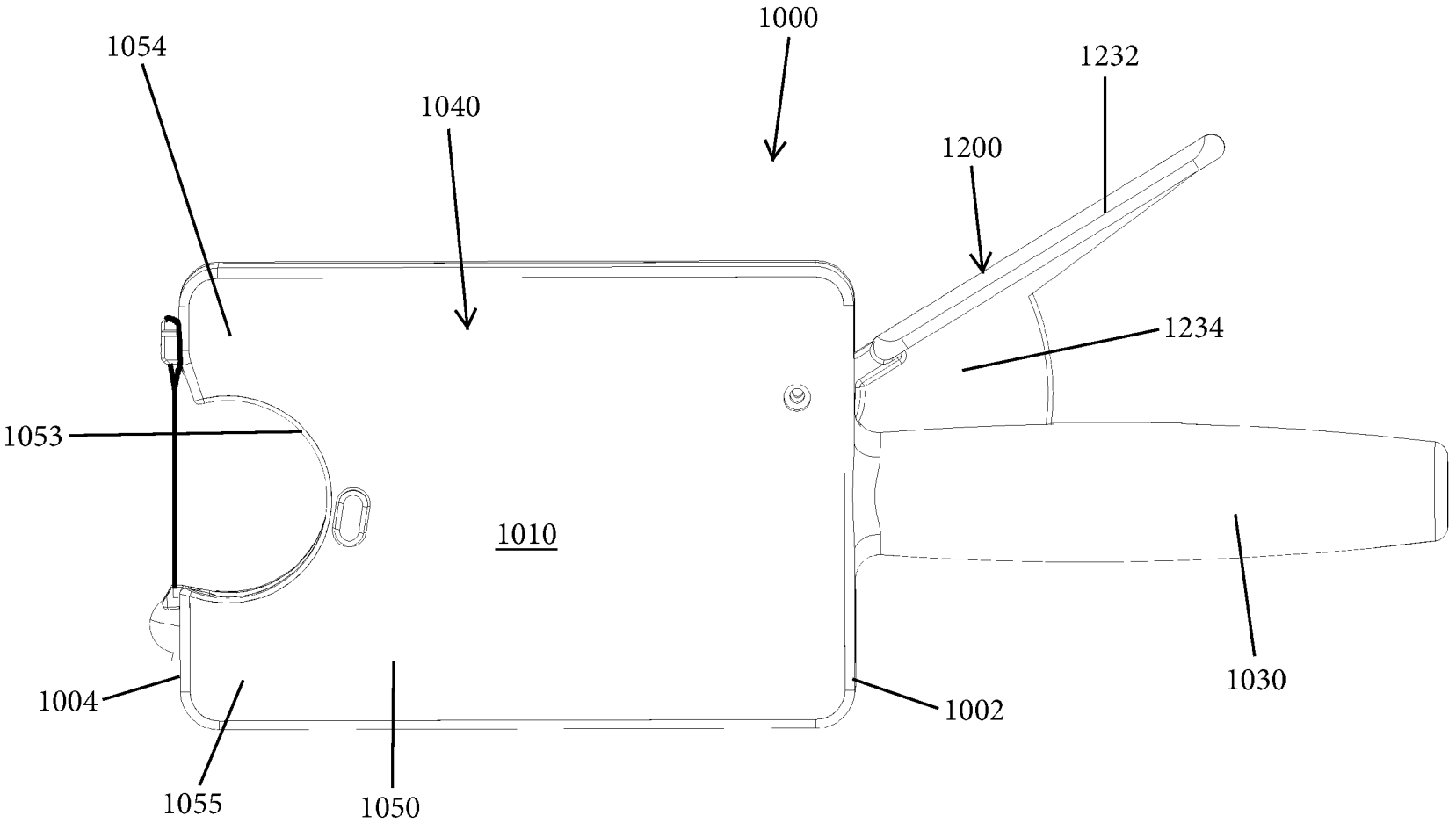
FIG. 10 is a front elevation view of a hair brush with an integral hair fastener applicator according to another embodiment and being shown in an open position.
Figure 11:
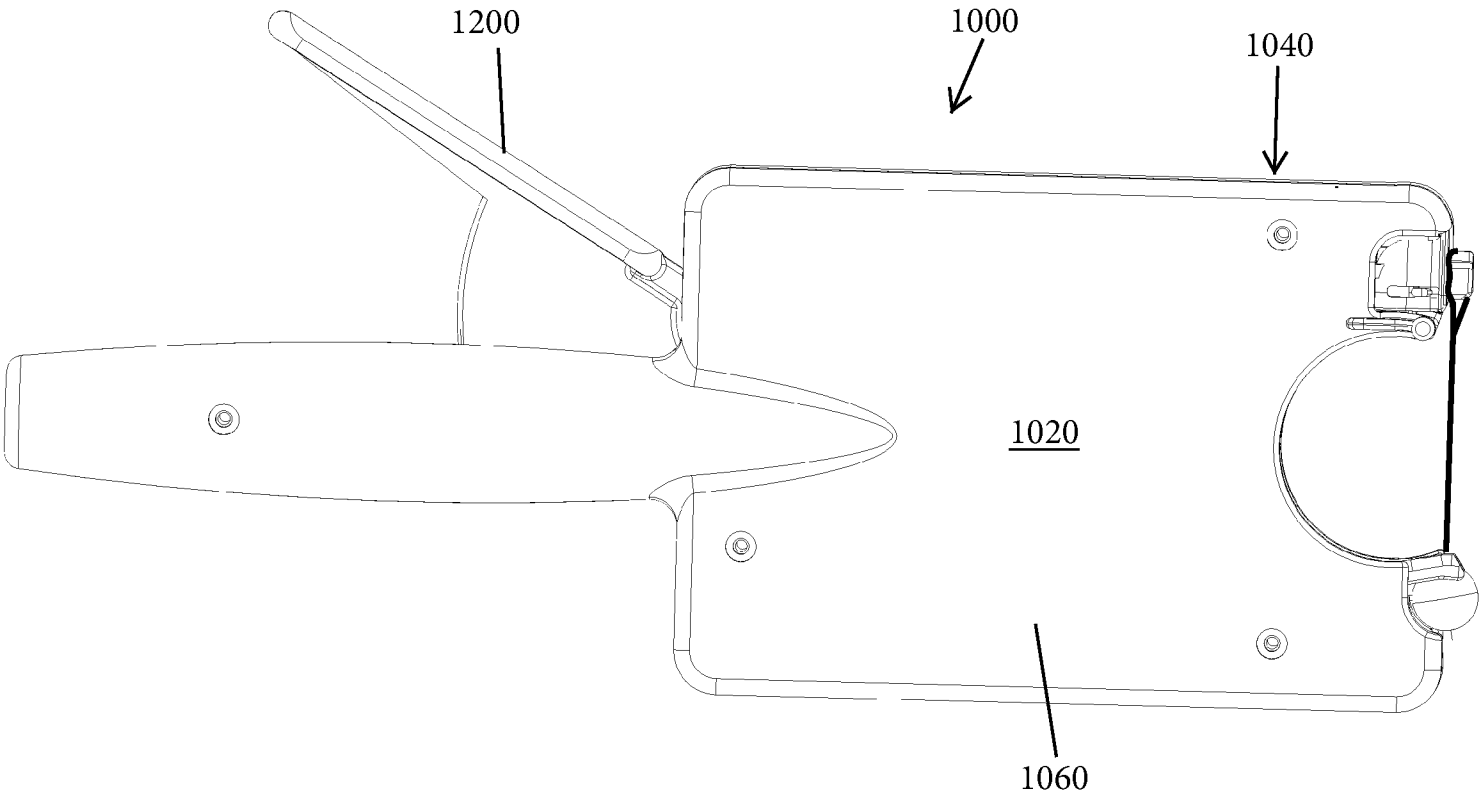
FIG. 11 is a rear elevation view thereof.
Figure 12:
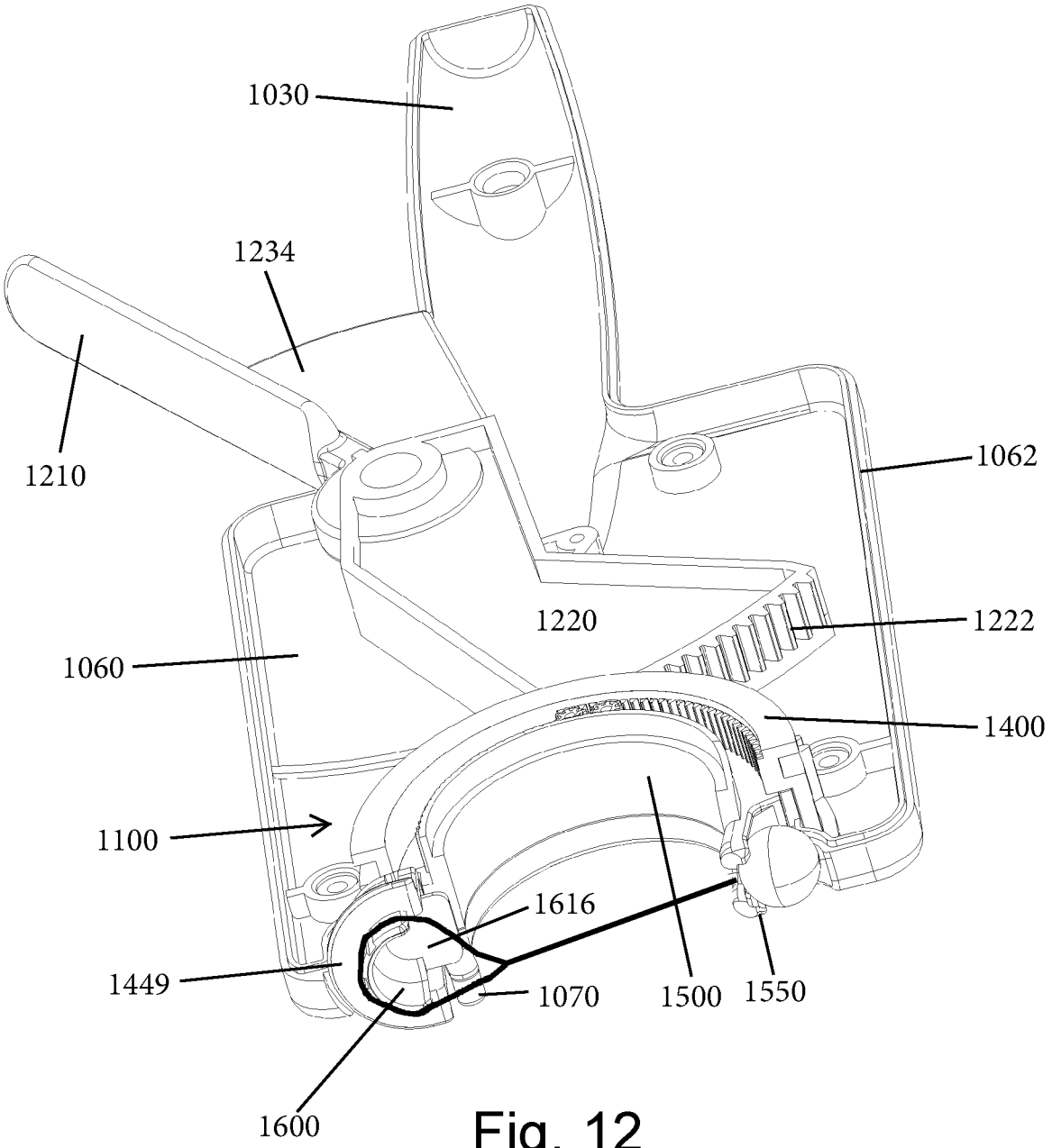
FIG. 12 is a partial perspective view thereof with one half of a housing being removed to show internal components.

When the user desires to tie a bundle of hair with a hair fastener, such as hair fastener 70, the user first places hair fastener 70 into the hair fastener applicator mechanism 1100. In particular, the hair fastener applicator mechanism is placed into the open position (FIG. 10) (i.e., trigger 1210 is not depressed) and hair fastener 70 is coupled to the first arm 1400 and the second arm 1500. To couple the hair fastener 70, the loop 72 of the fastener 70 is disposed about the outer surface of the main cup portion 1610. More particularly and as discussed previously, in the open position, the cup 1600 is in its fully extended position due to the biasing member (spring) applying a force to the cup 1600 which is contained within the socket 1440. When the cup 1600 is in this position, as shown in figures, the end 1602 of the cup 1600 extends beyond the flange 1449 and therefore, a right angle shoulder is formed between the flange 1449 and the outer surface of the main cup portion 1610. The loop 72 thus seats within this shoulder and is held in place. The ball 71 is inserted and held between the fingers 1550. More particularly, the ball 71 can be seated against the web 1552 adjacent the rear wall 1554, with an intermediate portion of the hair fastener 70 between the ball 71 and the loop 72 passing through the slot 1556. The hair fastener 70 is thus under tension since the ball 71 is held in place and the loop 72 is held in place with the intermediate portion therebetween being stretched so as to place the hair fastener 70 under tension. In this position, as shown in FIGS. 10-12, the hair fastener 70 is disposed across the cutout 1053 along the distal end of the brush 1000. The hair fastener 70 can thus be thought of as closing off the cutout 1053 and assumes a generally linear construction across the cutout 1053.

The user can brush his or her hair with the brush 1000 using the bristles 1001 thereof (FIG. 26A), then in preparation of fastening a bundle of hair, the user gathers the bundle of hair and separates it from the rest of the hair. The user then inserts the gathered bundle of hair into the cutout 1053 which results in deflection of the hair fastener 70 and in particular, the intermediate portion of the fair fastener 70 is brought into contact with or is placed in close proximity to the curved distal end of the main brush portion 1040. This results in the hair fastener 70 being placed under additional tension as a result of the deflection of the intermediate portion. In this position, the hair fastener 70 can be considered to assume a generally U-shape.

Next, the user actuates the hair fastener applicator mechanism 1100 by squeezing the trigger 1210. As discussed herein, the squeezing of the trigger 1210 causes the first arm 1400 and the second arm 1500 to pivot in opposite directions and this is translated into both the first arm 1400 and second arm 1500 extending outward from the distal end of the main brush portion 1040. In other words, the first arm 1400 and second arm 1500 are driven toward one another (along arcuate paths) and to the closed position of each.

It will be understood that the ball 71 is contained at one end of the second arm 1500 and the loop at one end of the first arm 1400 and thus, the closing action of the first arm 1400 and the second arm 1500 results in the ball 71 and the loop 72 being brought toward one another as a result of the forks 1050 being brought toward the cup 1600 and socket 1440.

Figure 16:
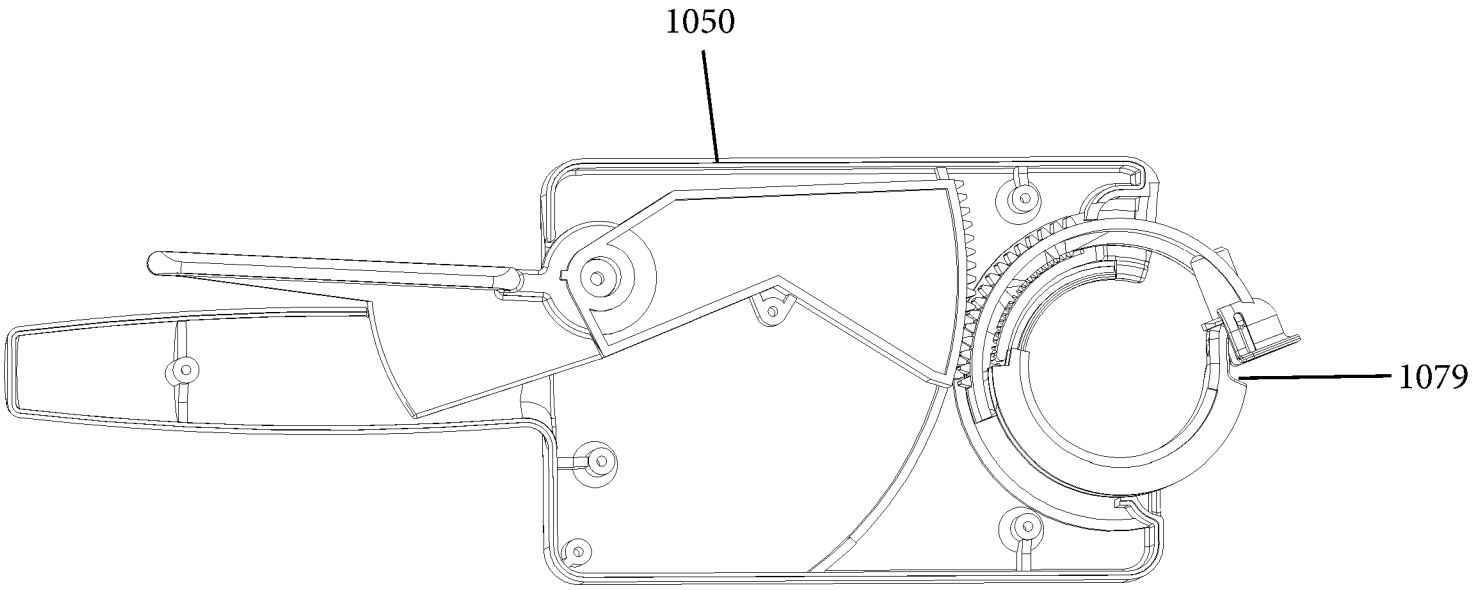
FIG. 16 is a partial perspective view thereof with one half of the housing being removed to show internal components.

As shown in the figures (e.g., FIG. 17), an outer portion of the floor 1616 that extends beyond the socket 1440 and terminates in the end 1617 can be thought of as being a flag portion of the cup 1600. The first and second arms 1400, 1500 are designed such that during the closing action, the distal ends of the fingers 1550 are brought into contact with the flag portion as shown in FIG. 16. FIG. 16 shows an initial closed position in which the ball 71 is still contained between the fingers 1055 and the loop 72 is still disposed about the cup 1600, with the intermediate portion of the hair fastener 70 extending circumferentially about the gathered bundle of hair. The contact between the fingers 1550 of the second arm 1500 and the floor 1616 (flag portion thereof) of the cup 1600 that is constrained within the socket 1440 results in the gathered hair bundle being completely encircled.

The fingers 1550, web 1552, and rear wall 1554 are formed such that when the ball 71 of the fastener 70 is held therein, there is a gap 1079 (FIG. 16) that is formed between held ball 71 and the rear wall 1554.

The operation of the trigger 1210 does not end with the arm positions shown in FIG. 16 but instead this is a momentary position and the squeezing of the trigger 1210 results in the fingers 1550 driving the cup 1600 within the socket 1440. More specifically, the cup 1600 rides axially within the socket 1440 due to the tabs 1620 being disposed within the guide slots 1460 which restrains the cup 1600 to axial movement only. As previously mentioned, a spring applies an outwardly directed biasing force to the cup 1600 and thus, the pushing action of the fingers 1550 causes the cup 1600 to retract within the socket 1440 and the spring compresses and stores energy. One end of this spring can be disposed about the post portion 1650 and the other end is disposed at the end (floor) of the hole 1447 formed in the floor 1444. This retraction of the cup 1600 within the socket 1440 results in a progressively decreasing amount of surface contact between the loop 72 and outer surface of the cup 1600.

The cup 1600 and the socket 1440 are sized such that when the cup 1600 is fully retracted within the socket 1440, the proximal end of the main cup portion 1610 seats against the floor 1444 of the socket 1440 and this results in the end 1602 being disposed within the plane or below the plane of exposed face of the flange 1449. It will be appreciated that once the cup 1600 is driven to this location within the socket 1440 and assumes its end of travel, the loop 72 is no longer being held by the cup 1600 since it is only disposed against the flat surface of the flange 1449 but is not disposed about the outer surface of the main cup portion 1610 of the cup 1600. The concealment of the cup 1600 within the socket 1440 causes the loop 72 to be released from the cup 1600 and move into the gap 1079 (FIG. 16) between the ball 71 and the rear wall 1554 (e.g., loop 72 slides over the ball 71). When the loop 72 moves into the gap 1079, the ball 71 effectively passes through the loop 72, thereby forming a continuous hair fastener structure due to the loop 72 being passed over the ball 71. This represents the full closed position of the arm 1400 and arm 1500.

At this point, the user then releases the trigger 1210 and the return force of the spring 1215 causes the trigger 1210 to move back to its original state and as a result, the arms 1400, 1500 move back to their open positions. This movement of the arms 1400, 1500 back to their original open states results in the ball 71 of the hair fastener 70 being ejected from its located between the fingers 1550 since the hair fastener 70 is attached to the bundle of hair and thus resists motion of the arm 1500 in the opposite direction. Accordingly, the complete cycle is completed resulting in the hair fastener 70 being attached to the bundle of hair and the arms 1400, 1500 being returned to the at rest open positions.

The hair brush 1000 thus not only permits traditional brushing of the hair using traditional bristles 1001 but also incorporates the hair fastener applicator mechanism 1100 to allow for hair fasteners to be easily and reliably applied to a bundle of hair in an automated manner.

In some situations, the finger structure (finger) 1070 can act as a guide for the hair fastener 70 and in particular, the intermediate portion of the hair fastener 70 can be routed along and in contact with the post 1072. This can help maintain the position of the hair fastener 70 during the closing action when the arms 1400, 1500 are driven toward one another.

In one embodiment, the hair fastener 70 is constructed such that the loop 72 has a Y-shape interface with the intermediate portion of the hair fastener 70. This construction can help maintain the fastener 70 in place on the arm 1400.

It is to be understood that like numerals in the drawings represent like elements through the several figures, and that not all components and/or steps described and illustrated with reference to the figures are required for all embodiments or arrangements.

Thus, illustrative embodiments and arrangements of the present devices and methods provide a method for applying a hair fastener. The flowchart in the figures illustrates the operation of possible implementations of methods according to various embodiments and arrangements. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present disclosure, which is set forth in the following claims.

What is claimed is:

1. A hair brush configured to apply a hair fastener to a bundle of hair comprising:

a housing comprising:

first and second housing parts joined together to define a hollow interior therebetween, the hollow interior comprising first and second arcuate shaped guide tracks therein, the first and second housing parts each having a handle portion and a head portion extending from the handle portion, a plurality of bristles projecting outwardly from the head portion of one of the first and second housing parts, and a notch disposed at a terminal end of the head portion of each of the first and second housing parts, the terminal end being opposite the handle portion;

an actuator pivotably coupled to the housing such that a portion of the actuator moves between an extended position and a retracted position relative to the handle portion; and a hair fastener applicator mechanism coupled to the housing and to the actuator comprising first and second arcuate driven arms configured to carry a hair fastener; the first arcuate driven arm, driven by the actuator and disposed within the first arcuate shaped guide track, the second arcuate driven arm driven by the first arm and disposed within the second arcuate shaped guide track such that operation of the actuator causes the first and second arcuate driven arms to move between an open position and a closed position, wherein in the open position, the first and second arcuate driven arms are fully retracted into the hollow interior and are configured to hold a hair fastener in a stretched state between the first and second arcuate arms and spanning across the notch, thereby configured to receive the bundle of hair and capturing the hair by the fastener, and in the closed position, the first and second arcuate driven arms fully extend outwardly from the hollow interior such that distal ends of the first and second arcuate driven arms contact one another;

wherein during use, a hair fastener is secured to the first and second arcuate driven arms in the open position, a user's hair is placed against the hair fastener, the actuator is moved to the retracted position causing the first and second arcuate driven arms to move to the closed position, encircling the user's hair within the hair fastener.

2. The hair brush of claim 1, wherein the actuator comprises a trigger having a blade section and a fan section that extends radially outward from the blade section, and the fan section passes through a slot in the handle portion to permit retraction of the trigger.

3. The hair brush of claim 2, wherein the trigger has a distal end portion that is contained within the housing and has a first set of teeth formed along an arcuate shaped distal end of the distal end portion.

4. The hair brush of claim 3, wherein the distal end portion is wedge shaped and moves in a sweeping motion when the trigger moves between the extended position and the retracted position.

5. The hair brush of claim 1, wherein the actuator comprises a trigger having a first set of teeth formed at a distal end thereof that is contained within the housing.

6. The hair brush of claim 5, wherein the first arcuate driven arm includes a second set of teeth that is formed along an outer surface thereof, the second set of teeth meshing with the first set of teeth of the trigger such that pivoting of the trigger is translated into the first arcuate driven arm being driven within the first arcuate shaped guide track and the first arcuate driven arm includes a third set of teeth that is formed along an inner surface of the first arcuate driven arm that is opposite the outer surface, the third set of teeth meshing with a first gear, the first gear meshes with a fourth set of teeth disposed on an outer surface of the second arcuate driven arm such that movement of the first arcuate driven arm in a first direction within the first arcuate shaped guide track results in movement of the second arcuate driven arm in a second direction within the second arcuate shaped guide track resulting in first ends of the first driven arm and the second driven arm being driven toward one another as the first and second arcuate driven arms move from the open position to the closed position.

7. The hair brush of claim 6, wherein the first end of the first arcuate driven arm has a ball shaped socket formed thereat configured to receive an axially displaceable cup, the cup having a curved outer wall configured to receive a loop of the fastener, the first end of the second driven arm having a fork construction for holding a ball formed at an opposite end of the fastener.

8. The hair brush of claim 7, wherein the displaceable cup has a cup portion at a first end and a post portion at a second end, the cup portion including a floor that extends between the curved outer wall, wherein a first portion of the floor protrudes beyond the curved outer wall, the curved outer wall having at least one tab that is received with an axial guide slot formed in the socket to allow axial, sliding displacement of the cup relative to the socket, wherein the cup moves axially within the socket between a fully extended position and a fully retracted position.

9. The hair brush of claim 8, wherein the post portion is received within a hole formed in a floor of the socket and further including a spring having a first end disposed about the post portion and a second end disposed within a bottom of the floor, the spring applying an outward biasing force to the cup.

10. The hair brush of claim 7, wherein the cup has a flag portion that is positioned such that the fork construction contacts the flag portion as the first end of the second driven arm is driven toward the first driven arm and a degree of travel of the second driven arm is selected such that the fork construction drives the cup axially within the socket until the cup is in the retracted position and the cup is completely concealed within the socket, thereby being configured to release the loop from being held about the curved outer wall of the cup.

11. The hair brush of claim 10, wherein the fork construction comprises first and second fingers spaced apart from one another with a web formed between the first and second fingers, the web having a slot formed therein at distal ends of the first and second fingers, the slot being configured to receive an intermediate portion of the hair fastener that is located between the ball and the loop when the ball is cradled within the fork construction, the web terminated at a rear end wall that extends between the first and second fingers, wherein when the ball is cradled within the fork construction, a space is formed between the ball and the rear end wall, the space configured to receive the released loop after it slides over the ball, thereby resulting in the loop and ball being joined to form a continuous hair fastener.

12. The hair brush of claim 1, wherein the head portion of one of the first and second housings includes an internal storage compartment that is configured to hold a plurality of hair fasteners, the internal storage compartment disposed on a surface of the first or second head portion, opposite the plurality of bristles.

13. A hair brush system comprising:

a hair fastener having a discontinuous body defined by a first end and an opposite second end, the first end having a ball and the second end having a loop;

a hair brush comprising:

a housing having a handle portion and a brush portion;

an actuator having a first portion coupled to an interior of the housing, a first plurality of gear teeth disposed at a distal end of the actuator; and a hair fastener applicator mechanism coupled to the interior of the housing and to the actuator, the hair fastener applicator mechanism comprising:

a first driven arm having an arcuate shape, comprising first and second ends, and an inner face and an outer face extending between the first and second ends, the first end disposed on an interior of the housing and the second end comprising a first grasping portion disposed exterior to the housing, a second plurality of gear teeth disposed on the outer face, and a third plurality of gear teeth disposed on the inner face, and a second driven arm having an arcuate shape, comprising first and second ends, and an inner and outer face extending between the first and second ends, the first end disposed on an interior of the housing and the second end comprising a second grasping portion disposed exterior to the housing, and a fourth plurality of gear teeth disposed on the outer face of the arcuate shaped second arm, the first driven arm is disposed between the actuator and the second driven arm, the second driven arm is nested within the first driven arm, such that the first plurality of gear teeth engages with the second plurality of gear teeth and the third plurality of gear teeth operatively engages with the fourth plurality of gear teeth wherein operation of the actuator causes the hair fastener applicator mechanism to move between an open position in which the first and second driven arms overlap one another and each of the second ends is spaced apart and positioned immediately adjacent the housing, and a closed position in which the first and second arms overlap one another and are moved together along arcuate paths in opposite directions such that each of the second ends contacts one another, wherein during use, the first and second driven arms are in the first position, the loop is attached to the first grasping portion and the ball is attached to the second grasping portion such that the fastener is stretched therebetween, a user's hair is placed against the hair fastener, the actuator is moved to the retracted position causing the first and second driven arms to move to the closed position, encircling the user's hair within the hair fastener and engaging the loop with the ball to form a continuous hair fastener about the user's hair.

14. A hair brush system comprising:

a hair fastener that has a discontinuous body defined by a first end and an opposite second end, the first end having a ball and the second end having a loop;

a housing having a handle portion and a brush portion;

the handle portion having a proximal end and a distal end, the brush portion having a proximal end and a distal end, where the proximal end of the brush portion extends from the distal end of the handle, an actuator coupled to the housing; and a hair fastener applicator mechanism disposed at the distal end of the brush portion, comprising a first driven arm having an arcuate shape and a second driven arm having an arcuate shape, the first and second driven arms are operatively engaged with the actuator such that operation of the actuator causes the first and second driven arms to move along arcuate paths in opposite directions between an open position and a closed position, the first driven arm is disposed between the actuator and the second driven arm, and the second driven arm is nested within the first driven arm such that the first and second driven arms overlap one another in both the open position and in the closed position, the second driven arm carries the ball and is operatively coupled to the first driven arm such that actuation of the actuator causes the first driven arm;

wherein a first end of the first driven arm has a ball shaped socket comprising a side wall and an outer flange disposed at a distal end thereof, the side wall comprising a plurality of axial guide slots, and a cup comprising two tabs disposed within the axial guide slots such that the cup is axially displaceable within the ball shaped socket between a fully extended position where the cup protrudes outwardly beyond the outer flange and a fully retracted position where the cup lies within or below a plane of the outer flange, wherein a first end of the second driven arm comprises a fork, and wherein during use, the loop of the hair fastener is disposed about the cup while the cup is in the fully extended position, and the ball of the hair fastener is held by the fork of the second driven arm holds the ball of the hair fastener such that the hair fastener is stretched between the first and second driven arms the first ends of the first and second driven arms are brought together by depressing the actuator, thereby placing the cup into the fully retracted position in which the loop is placed over the ball and released from the cup to apply the hair fastener around a bundle of a user's hair.

* * * * *